US008752644B2

(12) United States Patent
Weusthof

(10) Patent No.: US 8,752,644 B2
(45) Date of Patent: Jun. 17, 2014

(54) ELECTRIC TOOL, PARTICULARLY A SAW

(76) Inventor: Gerhard Weusthof, Schapen (DE)

( * ) Notice: Subject to any disclaimer, the term of this patent is extended or adjusted under 35 U.S.C. 154(b) by 488 days.

(21) Appl. No.: 13/128,298

(22) PCT Filed: Nov. 9, 2009

(86) PCT No.: PCT/EP2009/007984

§ 371 (c)(1),
(2), (4) Date: May 9, 2011

(87) PCT Pub. No.: WO2010/052015

PCT Pub. Date: May 14, 2010

(65) Prior Publication Data

US 2011/0214893 A1 Sep. 8, 2011

(30) Foreign Application Priority Data

Nov. 10, 2008 (DE) ..... 10 2008 056 563

(51) Int. Cl.
*B25F 5/02* (2006.01)

(52) U.S. Cl.
USPC ..... 173/170; 173/217; 30/369; 30/392; 83/471.3; 451/340

(58) Field of Classification Search
USPC ..... 173/170, 217, 171; 451/344, 340; 30/210, 216, 369, 392; 16/110.1, 430, 16/431, 422, 426; 83/473, 490, 581, 471.3
See application file for complete search history.

(56) References Cited

U.S. PATENT DOCUMENTS

| | | | | |
|---|---|---|---|---|
| 2,575,296 | A * | 11/1951 | Rogers | 30/519 |
| 4,643,263 | A * | 2/1987 | Karden | 173/168 |
| 5,159,864 | A | 11/1992 | Wedemeyer et al. | |
| 5,596,810 | A * | 1/1997 | Neubert et al. | 30/369 |
| 5,752,421 | A | 5/1998 | Chang | |
| 5,937,720 | A | 8/1999 | Itzov | |
| 6,595,095 | B2 * | 7/2003 | Chen | 83/473 |
| 6,658,976 | B2 * | 12/2003 | Dils et al. | 83/471.3 |
| 6,769,338 | B2 | 8/2004 | Svetlik et al. | |
| 7,204,026 | B2 * | 4/2007 | Phillips et al. | 30/394 |
| 7,407,018 | B2 * | 8/2008 | Sasaki | 173/170 |
| 7,537,065 | B2 * | 5/2009 | Gallagher et al. | 173/170 |
| 7,549,196 | B2 * | 6/2009 | Ziegs et al. | 16/430 |
| 8,156,656 | B2 * | 4/2012 | Tate et al. | 30/392 |
| 2006/0156883 | A1 | 7/2006 | Kenyon et al. | |
| 2006/0230623 | A1 | 10/2006 | Ziegs et al. | |
| 2009/0104861 | A1 | 4/2009 | Van Der Linde et al. | |

FOREIGN PATENT DOCUMENTS

| | | | |
|---|---|---|---|
| DE | 2443550 | C3 | 3/1977 |
| DE | 2829297 | A1 | 1/1980 |
| DE | 4302676 | A1 | 8/1994 |
| DE | 19632229 | A1 | 3/1997 |

(Continued)

*Primary Examiner* — Scott A. Smith

(74) *Attorney, Agent, or Firm* — Laurence A. Greenberg; Werner H. Stemer; Ralph E. Locher

(57) ABSTRACT

An electric tool, particularly a saw, has a connecting region and an actuating handle. The actuating handle is pivotally arranged on the connecting region, wherein the actuating handle can be pivoted into a number of pivoted positions and the actuating handle has at least one actuating switch for the electrical actuation of the electric tool. An uncomfortable position of the hand during actuation of the actuating handle is avoided and a high degree of comfort is achieved by the connecting region and the actuating handle being connected to each other by way of an articulated connection and by the articulated connection having a bearing lug and a handle pivot pin in engagement with the bearing lug.

19 Claims, 16 Drawing Sheets

(56) References Cited

FOREIGN PATENT DOCUMENTS

| | | | |
|---|---|---|---|
| DE | 69631976 | T2 | 8/2004 |
| DE | 202006012418 | U1 | 11/2006 |
| DE | 60307557 | T2 | 8/2007 |
| DE | 202007001945 | U1 | 6/2008 |
| EP | 0611632 | A1 | 8/1994 |
| EP | 0622015 | A1 | 11/1994 |
| EP | 1541305 | A1 | 6/2005 |
| EP | 1614492 | A1 | 1/2006 |
| EP | 1702724 | A2 | 9/2006 |
| EP | 1955801 | A2 | 8/2008 |
| WO | 2007121534 | A1 | 11/2007 |

* cited by examiner

B-B (1 : 2)

A-A (1 : 2)

A-A (1 : 2)

ELECTRIC TOOL, PARTICULARLY A SAW

BACKGROUND OF THE INVENTION

Field of the Invention

The invention relates to an electric tool, particularly a saw, having a connection region and an activation handle, wherein the activation handle is disposed on the connection region so as to pivot, wherein the activation handle can be pivoted into multiple pivot positions, and the activation handle has at least one activation switch for electrical activation of the electric tool.

While the invention is not restricted to saws, use of the invention in the case of a compound miter saw is particularly advantageous. In particular, however, the invention relates to a compound miter saw and miter saw. The electric tool preferably has a work piece support table and a movable unit, preferably a movable arm, having a processing tool. The processing tool can be a sawing apparatus, a grinding apparatus, or also a drilling apparatus, for example. However, manually guided electric tools or machines are also possible.

Using a miter saw, it is possible to cut work pieces, particularly work piece rods, at an angle that deviates from a right angle—the miter angle. In this connection, the work piece is laid onto a work piece support table of the miter saw. A sawing apparatus (as the processing tool) is disposed on an arm above the work piece support table, to saw the work piece. The sawing apparatus has an electric motor and a saw blade that is disposed so as to rotate and can be driven by the electric motor. The arm is preferably mounted to rotate about a vertical axis, on a means of rotation, for functional action. The angle of rotation can be adjusted by means of rotating the arm. Furthermore, the arm can preferably pivot about a miter axis, where the miter axis extends essentially perpendicular to the vertical axis, namely in a section plane. For this purpose, a pivot joint that can be fixed in place can be provided between the arm and the means of rotation.

A connection region on which an activation handle is disposed so as to pivot is provided on the electric tool, particularly the saw. The connection region is preferably formed on the arm of the saw, particularly on the miter arm of the miter saw or in the region of the saw unit/sawing apparatus preferably articulated onto the arm. This means that the activation handle is preferably disposed on the miter arm or on the saw unit so as to pivot about a handle pivot axle. In this connection, the activation handle can be pivoted into multiple pivot positions.

The activation handle furthermore has at least one activation switch for electrical activation of the electric tool. By means of activating the activation switch, a sawing apparatus assigned to the miter arm can be activated, in particular, so that an electric motor of the sawing apparatus is supplied with current by means of corresponding activation of the activation switch, and a saw blade is driven by the electric motor. The miter arm can preferably be lowered in part, using the activation handle, thereby causing the saw blade to then cut through the tool [sic—Werkzeug=tool should probably be Werkstück=work piece] that lies on the support table.

A miter saw having a connection region structured as a miter arm and having an activation handle is known from U.S. Pat. No. 6,769,338 B2. The activation handle can be pivoted into multiple pivot positions and has an activation switch for electrical activation of the miter saw. The miter arm can be inclined into various pivot positions, for example by 45° to the left and right relative to the vertical. The activation handle can be pivoted on the miter arm about a horizontal axis, which extends parallel to the section axis of the miter saw. The "handle pivot axis" of the activation handle is oriented parallel to the top of the support table. As a result, the activation handle can be oriented or pivoted parallel to the support table in the case of a laterally inclined miter arm. Furthermore, it is possible to pivot the activation handle in such a manner that the activation handle is disposed not transverse but rather parallel to the orientation of the saw blade. In this orientation, the activation handle cannot be grasped from above or below, but rather only from the side.

A miter saw having a work piece support table, an activation handle, and a "handle pivot axis" that extends parallel to the plane of the work piece support table is known from U.S. Pat. No. 6,658,976 B2. Again, this activation handle can be pivoted into an upward pivot position, i.e. essentially parallel to the saw blade, and into a pivot position perpendicular to the saw blade of the miter saw. In the pivot position parallel to the saw blade, the activation handle cannot be grasped from above or below, but, once again, rather only from the side.

The electric tools known from the state of the art, particularly the known compound miter saws and miter saws, are not yet optimally configured. In the case of the known miter saws, the pivot position of the activation handle cannot be adjusted with sufficient flexibility so that both left-handed and right-handed users can grasp the activation handle with equal ease. It is actually possible, if the hand position during sawing is uncomfortable, that the saw cut will fail as a result, or will not be carried out with the required precision. In particular, in the case of sawing work that continues for a long time, the user's hand can become tired more easily and cramp up, if it is in an uncomfortable position.

BRIEF SUMMARY OF THE INVENTION

The invention is therefore based on the task of configuring and further developing the electric tool mentioned above, in such a manner that an uncomfortable hand position during activation of the activation handle is avoided, and, in particular, the ease of use for the user is increased.

The task stated above is now accomplished in that the connection region and the activation handle are connected with one another by means of an articulated connection, and that the articulated connection has a bearing eye and a handle pivot axle that stands in engagement with the bearing eye. As a result of the articulated connection configured in this manner, the activation handle can be pivoted in a plane. Therefore the activation handle can preferably be grasped in pronated manner in all pivot positions. In other words, the user of the electric tool can grasp the activation handle with an overhand grip—back of the hand upward, palm of the hand downward. The possibility of grasping the activation handle with an overhand grip as a left-handed user and as a right-handed user, in all pivot positions, makes comfortable work possible. Because of the configuration of the articulated connection as described above, the possibility of grasping the handle with a pronated hand position does not change even if the activation handle is pivoted into different pivot positions (pivot positions) [Translator's Note as above]. In particular, the activation handle has a defined top and a defined underside as a result, where the orientation is not changed as the result of a pivot movement of the activation handle. The articulated connection is preferably structured in such a manner that the handle pivot axle extends transverse to a connection direction that extends between the connection region and the activation handle. This has the advantage that the activation handle can be pivoted essentially in the plane of the connection direction, and preferably transverse to the miter arm of a saw. The handle pivot axle, which is essentially formed by a handle pivot axle element that stands in engagement with the bearing eye, preferably extends parallel to a saw plane or to the saw blade of the saw.

The handle pivot axle therefore preferably extends parallel to the plane in which the saw blade of the miter saw can be lowered, or lies precisely in this saw blade plane, particularly if the activation handle is disposed above the sawing apparatus. The activation handle is preferably configured in frame-like manner and disposed transverse, particularly essentially perpendicular to the saw plane. Thus, the activation handle extends essentially horizontally (when the saw unit is folded down), in all its pivot positions, always essentially in the same plane. Preferably, the activation handle can be pivoted into at least three pivot positions that can be activated. In one pivot position, the activation handle can be directed to the right relative to the arm (miter arm). In another pivot position, the activation handle can be oriented centered relative to the arm. In yet another pivot position, the activation handle can be directed to the left relative to the arm. In the centered pivot position, the activation handle—if it is disposed above the saw blade of the compound miter saw and miter saw—is suitable for both right-handed and left-handed users, in this centered pivot position. If the saw blade is disposed in the swung-down position in the case of a compound miter saw and miter saw (as the electric tool), then the handle pivot axle of the activation handle is preferably oriented essentially vertically relative to the top/plane of the work piece support table. The handle pivot axle then extends upward, parallel to the saw blade, or, if the activation handle is disposed centered directly above the saw unit, lies directly in the plane of the saw blade, with a vertical orientation relative to the top of the work piece support table. The disadvantages described initially are therefore avoided, and corresponding advantages are achieved.

There is now a plurality of possibilities for configuring and further developing the The electric tool according to the invention in advantageous manner. For this purpose, first of all reference will be made to the dependent claims that follow the independent claim(s). In the following, a preferred embodiment of the invention will now be explained in greater detail using the drawing and the related description.

DESCRIPTION OF THE INVENTION

Figure 1:
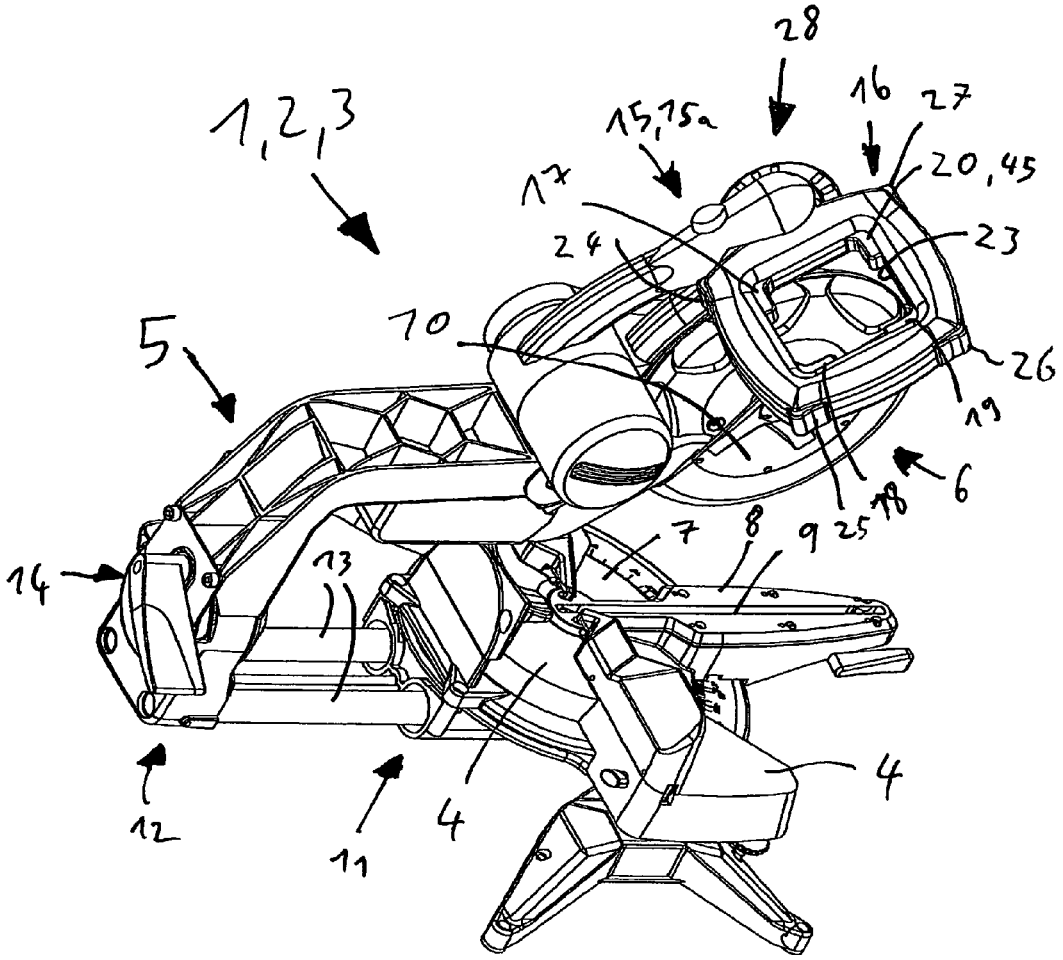
FIG. 1 in a schematic, perspective representation, an electric tool, namely a compound miter saw and miter saw, at a slant from above, right rear, with an activation handle in a first pivot position, FIG. 2 in a schematic, perspective representation, the compound miter saw and miter saw from FIG. 1, with the activation handle in a further, second pivot position, FIG. 3 in a schematic, perspective representation, the compound miter saw and miter saw with the activation handle in a third pivot position, FIG. 4 in a schematic, perspective detail representation, the activation handle and a connection region of the compound miter saw and miter saw from FIGS. 1 to 3, FIG. 5 in a schematic top view, the activation handle and the connection region in another pivot position, FIG. 6 in a schematic exploded view, the activation handle and the connection region, FIG. 7*a* in a schematic, perspective detail representation, the activation handle and the connection region, where a housing part of the connection region was removed, FIG. 7*b* in a schematic side view, the connection region and the activation handle in a specific pivot position, FIG. 8 in a schematic top view, the activation handle and the connection region, FIG. 9 in a schematic sectional view along the line G-G from FIG. 8, the activation handle and the connection region, FIG. 10 in a schematic sectional view along the line B-B from FIG. 7*b*, the activation handle and the connection region (from below) but in a different pivot position, where a housing part of the connection region was removed and an activation switch is activated, FIG. 11 in a schematic, perspective representation, the activation handle and the connection region (from below) but in a pivot position as in FIG. 10, where multiple housing parts of the activation handle and of the connection region were removed and an activation switch is activated, FIG. 12 in a schematic, perspective representation, the activation handle and the connection region in a similar representation as in FIG. 11, where here, the activation switch is not activated, FIG. 13 in a schematic sectional view along the line B-B from FIG. 7*b*, the activation handle and the connection region, in a similar representation as in FIG. 10, but with the activation switch not activated (non-activated), FIG. 14 in a schematic sectional view, the activation handle and the connection region similar to FIGS. 10 and 13, where an activation switch is not activated and the activation handle is disposed in a centered pivot position, FIG. 15 in a schematic, perspective representation, the activation handle and the connection region in the centered pivot position, FIG. 16 in a schematic sectional view along the line B-B of FIG. 7*b*, the activation handle and the connection region in the centered pivot position, where the activation switch is activated, FIG. 17 in a schematic, perspective representation, the activation handle and the connection region of the centered pivot position from FIG. 16, FIG. 18 in a schematic, perspective representation, the activation handle and the connection region in a pivot position to the right, with a non-activated activation switch, FIG. 19 in a schematic sectional view along the section line A-A from FIG. 7*b*, from above, the activation handle and the connection region, in the pivot and activation position shown in FIG. 18, FIG. 20 in a schematic, perspective representation, the activation handle and the connection region in the pivot position shown in FIG. 18, where the activation switch is activated, FIG. 21 in a schematic sectional view along the line A-A of FIG. 7*b*, the activation handle and the connection region similar to FIG. 19, where the activation switch is activated, FIG. 22 in a schematic, perspective representation, the activation handle and the connection region in a centered pivot position, where the activation switch is not activated, FIG. 23 in a schematic sectional view along the line A-A of FIG. 7*b*, the activation handle and the connection region, in a pivot position corresponding to FIG. 22, FIG. 24 in a schematic, perspective representation, the activation handle and the connection region in a centered pivot position, where here, the corresponding activation switch is activated, and FIG. 25 in a schematic sectional view along the line A-A of FIG. 7*b*, the activation handle in the centered pivot position shown in FIG. 24, where the corresponding activation switch is activated.
Figure 2:
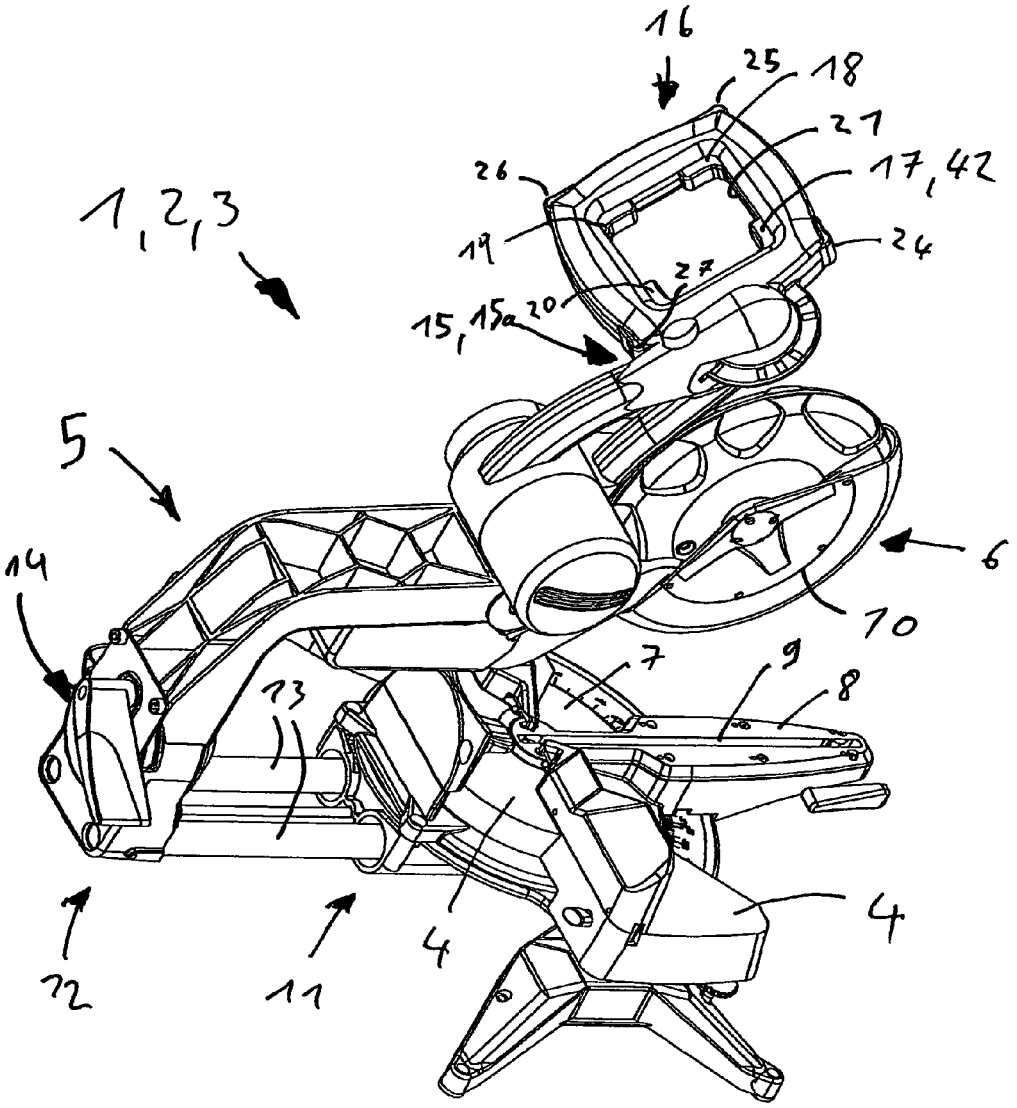
Figure 3:
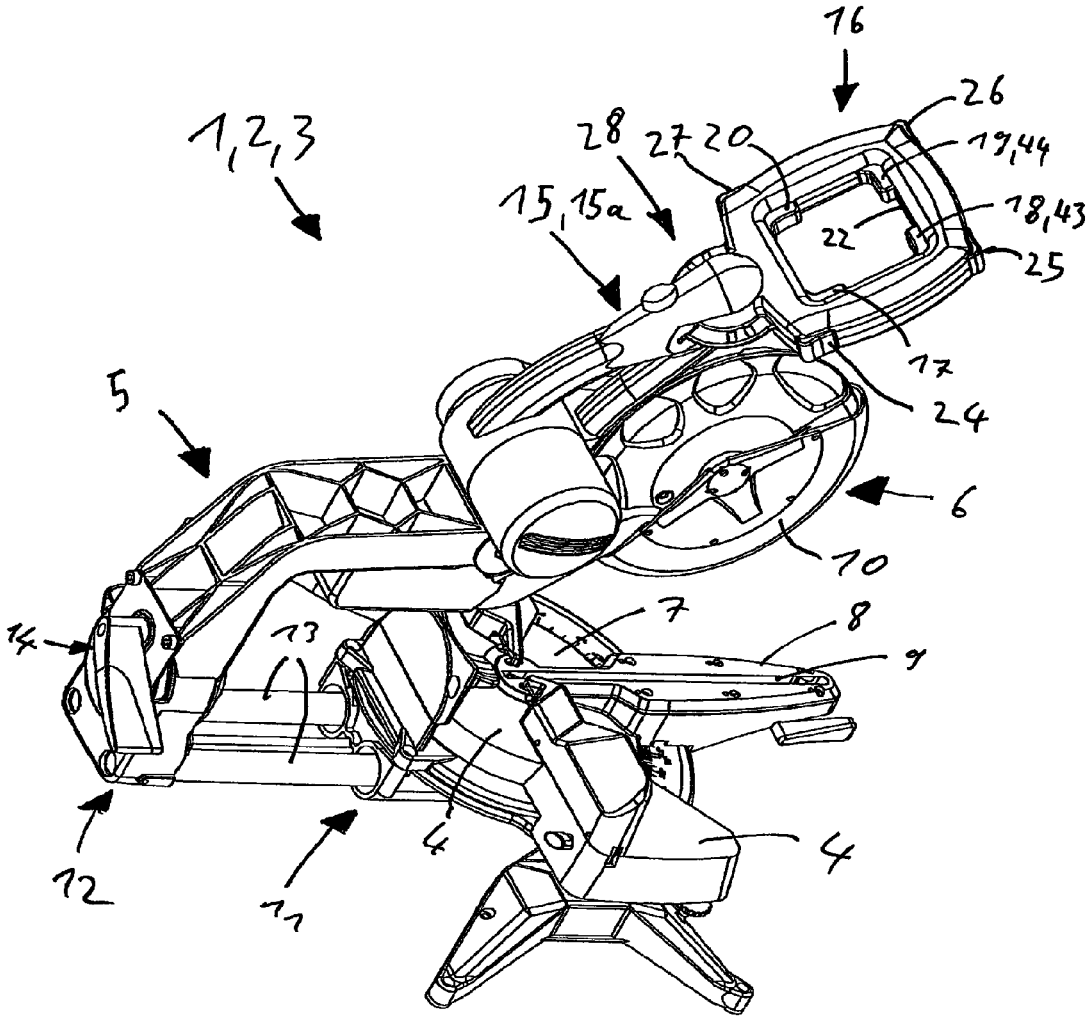

An electric tool can be seen well in FIGS. 1, 2, and 3.

Here, the electric tool is configured as a saw 2, particularly as a compound miter saw and miter saw.

The electric tool 1 preferably has a work piece support table 4. A work piece, not shown, can be laid onto the work piece support table 4 for processing. The electric tool 1 preferably has an arm 5. In particular, a work piece processing apparatus—here, in particular, a sawing apparatus 6—is disposed on the arm 5, preferably once again so as to pivot. The work piece processing apparatus, preferably the sawing apparatus 6, therefore is disposed so that it can preferably be pivoted upward and lowered. Here, the sawing apparatus 6 can be pivoted in the direction of the work piece support table 4, in other words up and down, about a transverse axle that is not indicated in any detail here, relative to the arm 5.

In an alternative embodiment, the electric tool 1 can be configured as a box column drill (not shown) or as a manually guided machine. In general, the invention relates to an electric tool 1 that can be activated with one hand. Here, the arm 5 can be activated with one hand, particularly pushed to the back and pulled to the front, where the sawing apparatus 6 can preferably be pivoted up and down, as well, using one hand.

In the following, the compound miter saw and miter saw 3 will be explained in greater detail as a preferred embodiment of the electric tool 1:

Using the compound miter saw and miter saw 3, strips, panels, or sheets, in particular, can be cut to the desired length, preferably including the desired miter cuts. Using the compound miter saw and miter saw 3, not only can cuts be made at a right angle to the longitudinal axis of the work piece, not shown, but also, miter cuts can be made at an acute angle relative to the longitudinal axis of the work piece.

The work pieces can particularly be disposed transversely on the work piece support table 4, in other words the work pieces preferably extend transversely on the work piece support table 4 with their longitudinal axis. A turntable 7 that is mounted so as to rotate, and is connected in one piece with a cantilever 8, extends underneath the work piece support table 4. In this connection, the cantilever 8 has a saw slit 9 into which the sawing apparatus 6 can plunge with the circular saw blade, which is covered by the saw blade cover 10. When the sawing apparatus 6 is lowered, the saw blade cover 10 preferably tilts back and exposes the circular saw blade (not shown).

The arm 5 is connected with the turntable 7 by way of a slide guide device 11 and a pivot articulation connection 12, in functionally effective manner. The slide guide device 11 preferably has two guide rods 13 that are disposed parallel to one another. The arm can preferably be rotated about a vertical axle, not shown, relative to the support table 4, for one thing, and for another, can be displaced in the longitudinal direction of the guide rods 13, in translational manner, using the slide guide device 11, and pivoted about the pivot axle 14, which is disposed parallel to the guide rods 13 here. So-called "double miter cuts" can be carried out with the compound miter saw and miter saw 3, by means of the pivot mobility of the arm 5 about the pivot axle 14 and the vertical axle.

The electric tool furthermore has a connection region 15 and an activation handle 16. The activation handle 16 is disposed on the connection region 15 so as to pivot. In this connection, the activation handle 16 can be pivoted into multiple pivot positions.

Three different pivot positions are shown in FIGS. 1, 2, and 3. In FIG. 1, a first pivot position of the activation handle 16 relative to the connection region 15 is shown, where here, the activation handle 16 is pivoted to the left, from the point of view of the user of the compound miter saw and miter saw 3. In FIG. 2, the activation handle 16 is pivoted to the right, relative to the connection region 15, from the point of view of the user. In FIG. 3, the activation handle is oriented centered relative to the connection region 15.

The "left" pivot position shown in FIG. 1 is particularly suitable for activating the electric tool 1 with the left hand, and then, the work piece could be held in place with the right hand. The "right" pivot position shown in FIG. 2 is suitable for activation of the arm 5 and the sawing apparatus 6 with the right hand, and then, the work piece could be held in place with the left hand. The centered pivot position shown in FIG. 3 is particularly suitable for left-handed or right-handed activation of the electric tool 1, and, in particular, a "force introduction" by the user is then also implemented in centered manner, and this is therefore particularly suitable for very clean cuts.

The activation handle 16 has at least one activation switch for electrical activation of the electric tool 1. Here, the activation handle 16 preferably has multiple activation switches. In the exemplary embodiment of the electric tool 1 shown here, four activation switches 17, 18, 19, 20 are preferably provided. The connection region 15 is preferably disposed in centered manner, in the plane of the sawing apparatus 6. Alternatively, the connection region 15 could be disposed offset relative to the saw blade plane. Here, the connection region 15 preferably extends essentially in the plane of the saw blade. Here, the connection region 15 is formed by a cantilever 15*a*. The cantilever 15*a* extends above the saw blade, preferably essentially in the saw plane. The cantilever 15*a* is rigidly connected with the sawing apparatus 6.

Figure 4:
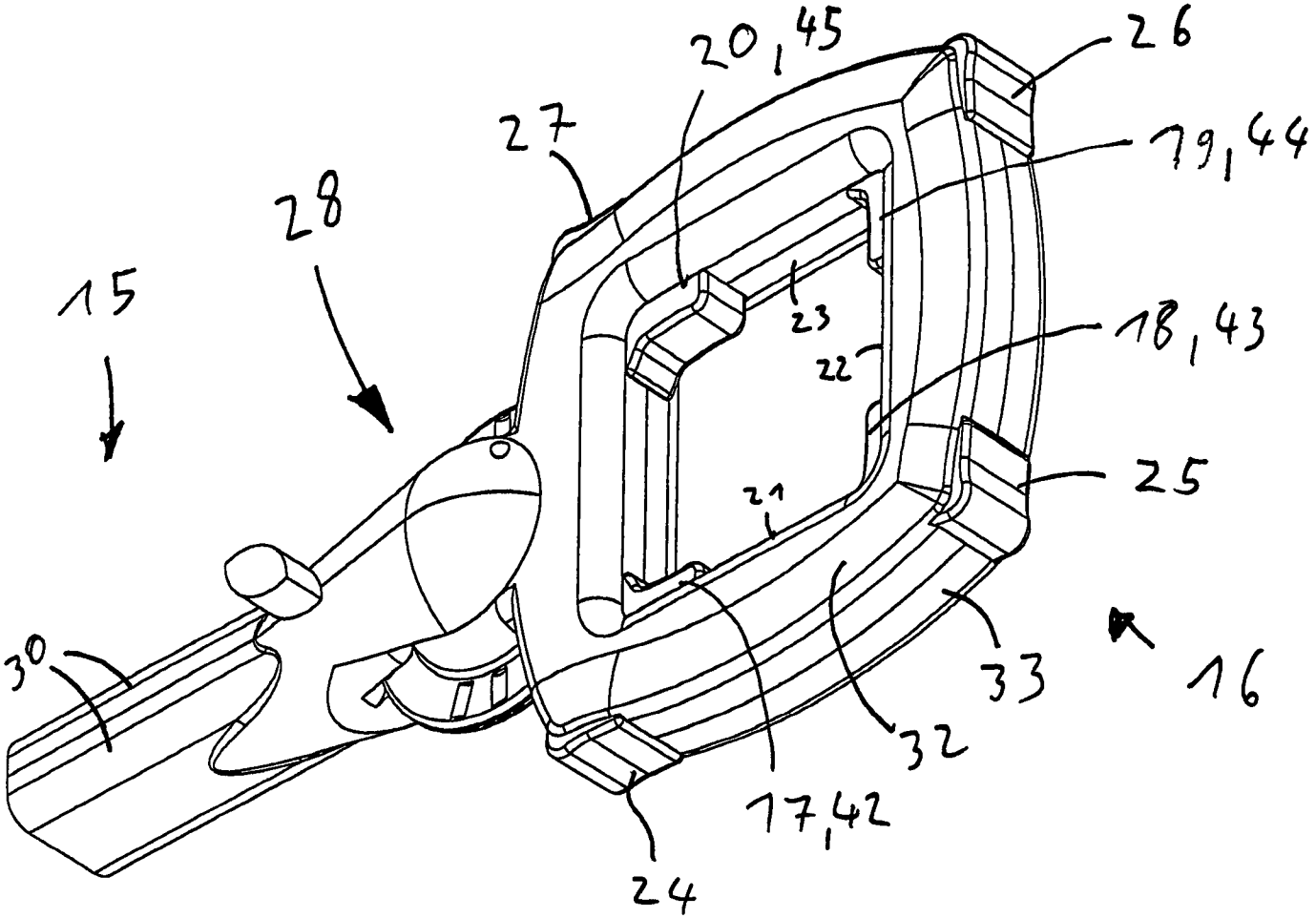
Figure 5:
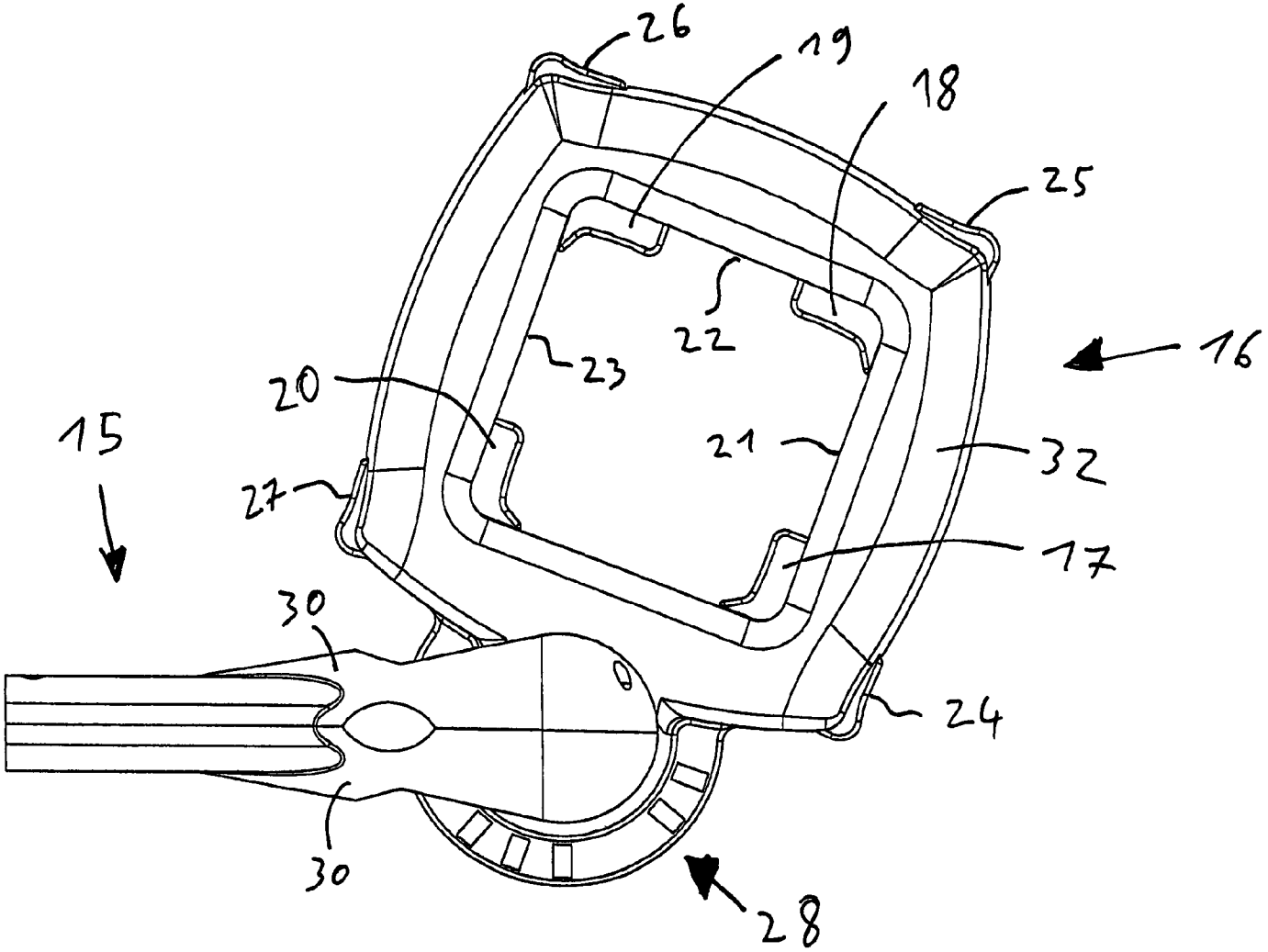

In the following, reference is now made to FIGS. 4 and 5.

It can be seen well that here, the activation handle 16 is configured essentially in frame shape and preferably has a rectangular shape. However, other shapes, preferably frame-like or partially frame-like shapes, are also possible.

The activation handle 16 has a shell-like housing. The activation switches 17, 18, 19, and 20 are disposed in such a way, in each instance, that they can preferably be activated with the index finger and/or the middle finger. For this purpose, the activation switches 17, 18, 19, 20 are preferably disposed on three inner sides 21, 22, 23 of the activation handle 16. In this connection, only one of the activation switches, in each instance—here, the activation switch 17 or 20, respectively—is assigned to the lateral inner sides 12 and 23, and two activation switches 18 and 19 are preferably assigned to the central inner side 22. In this connection, the activation switches 17, 18, 19, and 20 are configured essentially as a type of flat or profiled elements having a specific structure, and disposed accordingly within the shell-type housing of the activation handle 16, as will still be explained.

A securing switch 24, 25, 26, 27 is preferably assigned to each of the activation switches 17, 18, 19, 20. In this connection, the securing switches 24, 25, 26, 27 mechanically block a movement of the activation switches 17, 18, 19, 20, as long as the safety switches 24, 25, 26, 27 are not activated. [Translator's Note: Both the term Sicherungsschalter=securing switch and the term Sicherheitsschalter=safety switch are used here.]

The disadvantages described initially are now avoided in that the connection region 15 and the activation handle 16 are connected with one another by means of an articulated connection 28, and that the articulated connection 28 has a bearing eye 28*a* and a handle pivot axle 29 that stands in engagement with the bearing eye 28*a*. This has the advantage that the activation handle 16 can be pivoted in a plane, preferably transverse to the saw plane, particularly essentially at a right angle to it. By means of the articulated connection 28, the activation handle 16 can be grasped with a pronated hand position, i.e. back of the hand up and palm of the hand down, in all pivot positions. In the case of the preferred embodiment shown here, the activation handle 16 has the bearing eye 28*a*, where the bearing eye 28*a* preferably completely encloses the handle pivot axle 29 (which can also be referred to as a bolt-type handle pivot axle element), in the present preferred embodiment. Here, what is important is the combination of the handle pivot axle 29 (or the handle pivot axle element) with a bearing eye configured in terms of functional technology, in order to implement engagement of the handle pivot axle 29 (or the handle pivot axle element) into the corresponding region of the bearing eye, so that while the activation handle 16 can preferably be pivoted into different pivot positions, it can preferably be pivoted essentially in the same plane.

It is particularly advantageous that the activation handle 16, in the centered pivot position (cf. FIG. 3), also extends essentially perpendicular to the saw blade or to the saw plane. Because the activation handle 16 can be pivoted in a plane through the articulated connection 28, the activation handle 16 can always be grasped from the same side—preferably from above. This has the advantage that the activation handle 16 can comfortably be grasped in all pivot positions, thereby making precise and relaxed guidance of the arm 5 with the sawing apparatus 6 possible while sawing.

In the following, reference is made to FIGS. 6, 7*a*, 7*b*, 8, and 9. The articulated connection 28 has a handle pivot axle 29 preferably assigned to the connection region 15 (where the element designated with the reference symbol "29" here can also be referred to as a handle pivot axle element). The activation handle 16 is mounted on the handle pivot axle 29 so as to pivot, and for this purpose preferably has the bearing eye 28*a*. The handle pivot axle 29 preferably extends transverse to the activation handle 16, i.e. transverse to the longitudinal expanse of the inner sides 21, 22, and 23 of the activation handle 16. The handle pivot axle 29 preferably extends transverse to the work piece support table 4. In the case of the compound miter saw and miter saw, particularly in the swung-down state of the sawing apparatus 6, the handle pivot axle 29 is therefore disposed or provided preferably vertical to the plane of the work piece support table 4.

The connection region 15 preferably has multiple shell parts. Here, the connection region 15 has two shell parts 30, which are preferably configured to have essentially the same construction. The connection region 15 preferably has an accommodation 31 into which the handle pivot axle 29 is inserted so as not to rotate, particularly with shape fit. Because of the fixed connection, the handle pivot axle 29 is assigned to the connection region 15 and not to the rotating activation handle 16. Here, the accommodation 31 is delimited by the two shell parts 30.

The activation handle 16 preferably has multiple handle shell parts, here the handle shell parts 32 and 33, by means of which the housing of the activation handle 16 is essentially formed. The handle shell parts 32 and 33 are preferably connected with one another by means of multiple screw, plug-in, and/or clamp connections, which are not indicated in greater detail here. The two shell parts 30 of the connection regions 15 are preferably connected with one another in the same manner.

The embodiment of the activation handle 16 shown here furthermore has a particularly advantageous activation mechanism (not indicated in any greater detail in its totality):

The connection region 15 preferably has an electrical contact element 34. The electrical contact element 34 is disposed between the two shell parts 30, preferably outside of the region of the activation handle 16, with shape fit. The connection region 15 furthermore has a switch element that can be displaced by means of the activation switches 17 to 20, and is preferably configured as a switch bracket 35. The contact element 34 can be activated by means of displacement of the switch element, here preferably the switch bracket 35.

The switch bracket 35 has a bracket 36, preferably in U shape, and a connection element 37. The bracket 36 is closed by means of the connection element 37 at the end of its shanks (not indicated in any greater detail), which run essentially parallel to one another. The connection element 37 connects the shanks of the bracket 36 (cf. FIG. 9).

The electrical contact element 34 is connected with the electric motor, not shown here, of the electric tool 1, particularly here, the electric motor that drives the saw blade, by way of electrical lines, not shown here. In an alternative embodiment and/or in addition, the saw blade cover 10 can also be locked and unlocked with the electrical contact element 34. The switch bracket 35 is disposed within the two shell parts in displaceable manner. The displacement direction is indicated with the double arrow D in FIG. 9.

The activation switches 17, 18, 19, 20 preferably have a switch hook 38, 39, 40, and 41 as an integral component, in each instance. In an alternative embodiment, the activation switches can be connected with a corresponding switch hook 38, 39, 40, 41, in functionally active manner. Furthermore, the activation switches 17, 18, 19, 20 have activation buttons 42, 43, 44, and 45—preferably as integral components (cf. FIG. 6).

The activation switches 18, 19 are assigned to the central pivot position (cf. FIG. 3) and can be activated only in this pivot position. In this connection, the activation switch 18 can particularly be activated with the index finger of the right hand, in the central pivot position. The related activation button 43 is disposed on the left (viewed from above) on the inner side 22. In this connection, the activation switch 19 can particularly be activated with the index finger of the left hand, in the central pivot position. The related activation button 44 is disposed on the right (viewed from above) on the inner side 22.

The activation switch 17 is assigned to the right pivot position (cf. FIG. 2) and can be activated only in this pivot position. In this connection, the related activation button can particularly be activated with the index finger of the right hand in the right pivot position. The activation button 42 is disposed on the left on the inner side 21. The activation switch 18 extends within the handle shell parts 32 and 33, along this inner side 21, and has a window 55 (cf. FIG. 6), through which the activation button 42 passes.

The activation switch 20 is assigned to the left pivot position (cf. FIG. 1) and can be activated only in this pivot position. In this connection, the related activation button 45 can particularly be activated with the index finger of the left hand in the left pivot position. The activation button 45 is disposed on the right on the inner side 23. The activation switch 19 extends within the handle shell parts 32 and 33, along this inner side 23, and has a window 56 (cf. FIG. 9), through which the activation button 45 passes.

The switch hooks 38, 39, 40, 41, by means of activation of the activation buttons 42, 43, 44, 45 on the activation handle 16 or preferably within the handle shell parts 32 and 33, are disposed in displaceable manner and/or configured to be movable and/or articulated on, in such a manner that—in the end result—the switch hooks 38, 39, 40, 41 can interact with the switch element, preferably with the switch bracket 35, in terms of function technology. In particular, the switch hooks 38, 39, 40, 41 can be moved in the direction of the double arrow D (cf. FIG. 9, here, to the right), when the activation button 42, 43, 44, 45 is activated in the pivot position of the activation handle 16, in each instance, thereby allowing the corresponding switch hook 38, 39, 40, 41 to engage on the connection element 37 and displacing the connection element 37, also together with the bracket 36, in the direction toward the center of the handle pivot axle 29. Preferably, in this connection, an activation button, an activation switch, and a switch hook form a corresponding activation element, which is disposed within the activation handle 16 in movable manner. This activation element can act in terms of function technology, in particular, by means of the switch hooks, in each instance, on a movable element disposed in the region of the handle pivot axle 29; preferably, the switch hook, in each instance, can act on the connection element 37 (as a part of the switch bracket 35), which element is preferably disposed in the region of the handle pivot axle 29, and here can be displaced toward the inside, in the direction toward the center of the handle pivot axle 29, in interaction with the switch hooks. In this way—as has already been mentioned above—the switch bracket 35 is then displaced in such a manner that a contact element 34 is activated. The contact element 34 and/or at least a part of the contact element 34 is preferably itself impacted by a spring force internally, so that in the event that the activation switch 17, 18, 19, 20, in each instance, or the activation buttons 42, 43, 44, 45 are no longer activated manually, a reverse movement takes place, on the basis of the spring force applied in the contact element 34, in other words a displacement of the connection element 37 in the radial direction, toward the outside, away from the center of the handle pivot axle 29. In other words—in the end result—the electronic [sic—probably should be electrical] contact element 34 is triggered by way of an element disposed, so as to move, in the region of the handle pivot axle 29.

In each of the pivot positions, only a part of the activation switches 17, 18, 19, 20 is disposed so as to be displaceable in the direction of the double arrow D.

Figure 14:
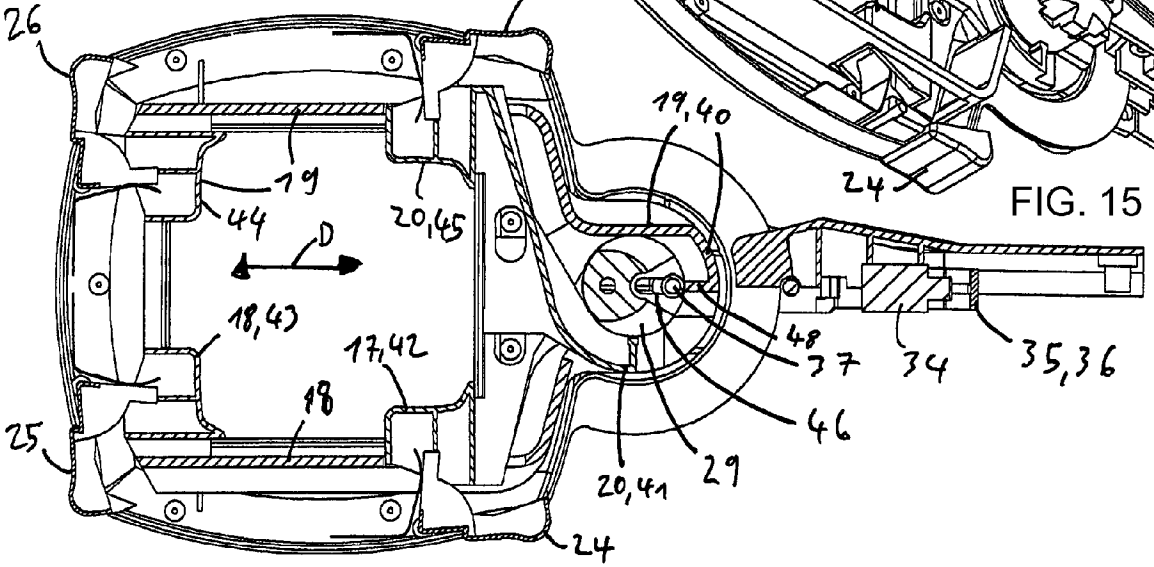
Figure 17:
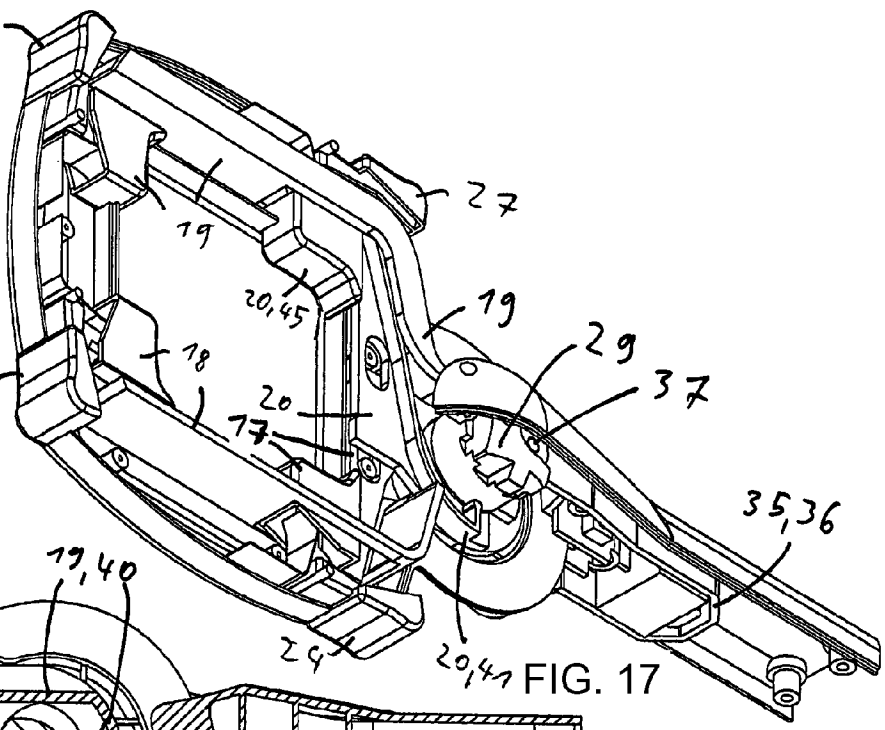
Figure 16:
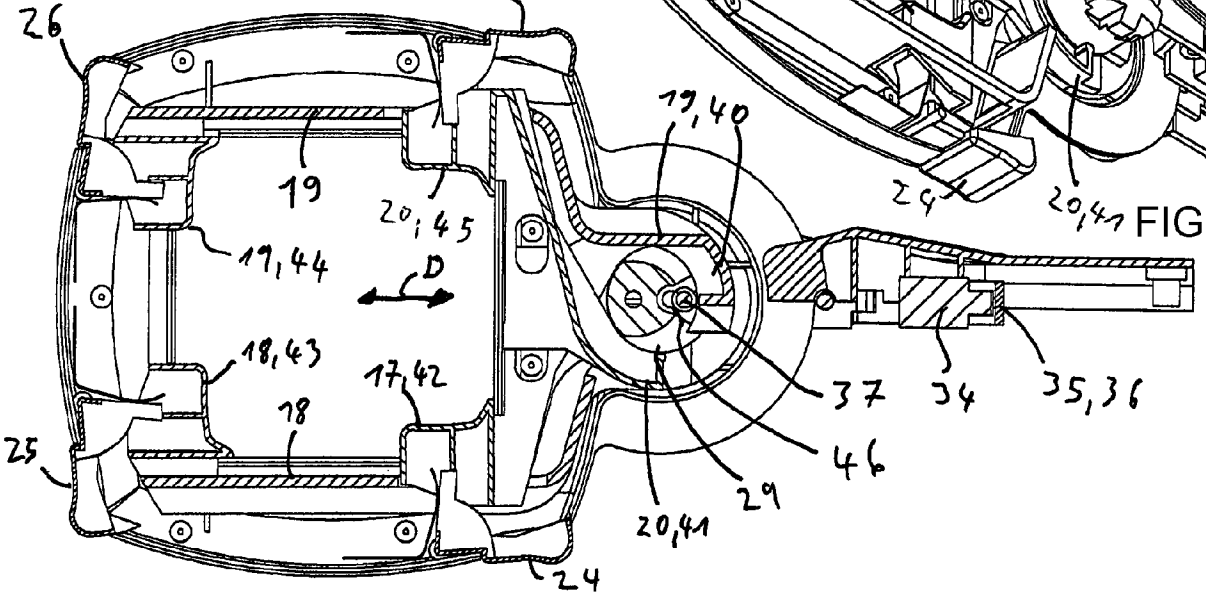
Figures 22, 23:
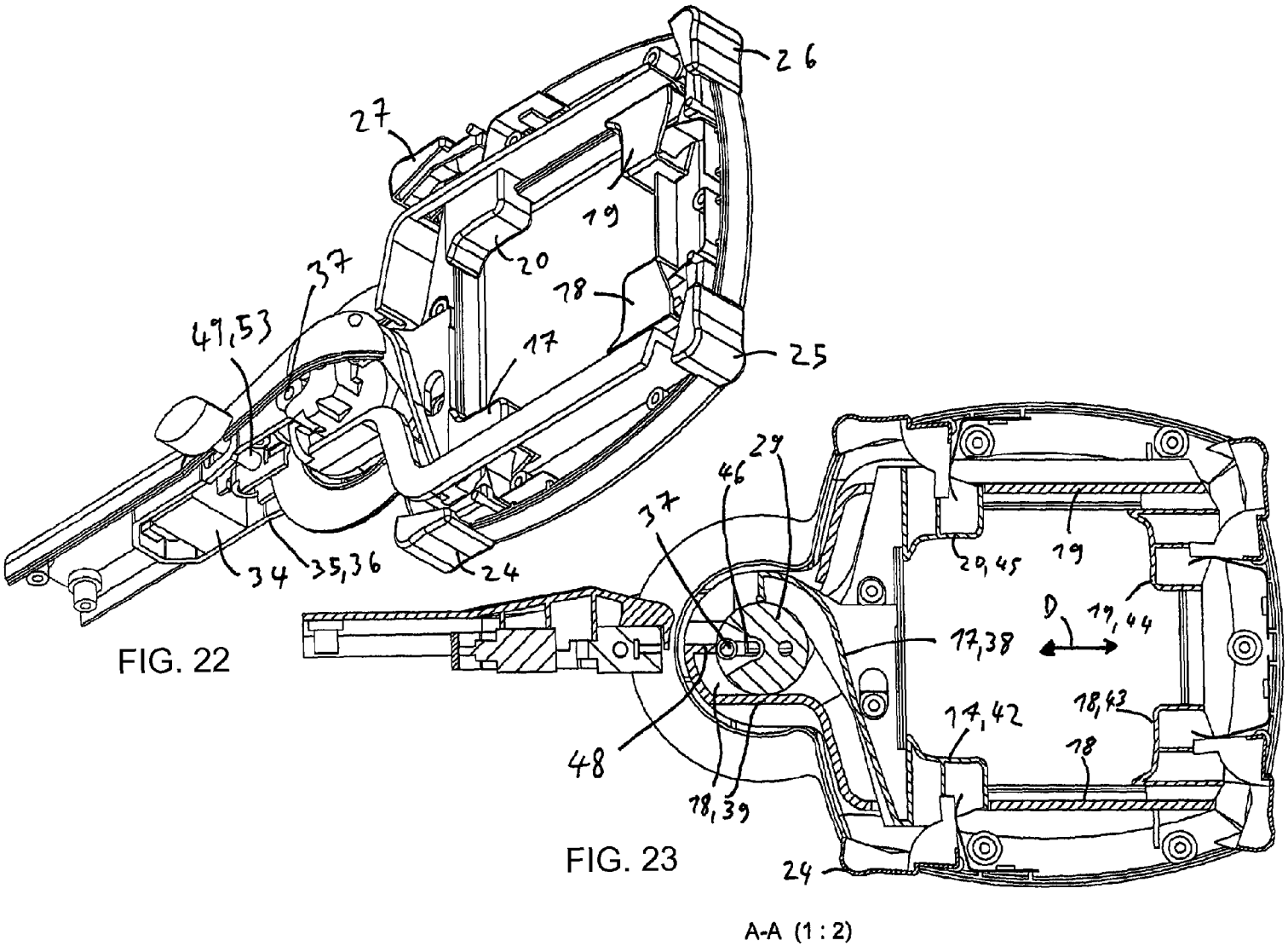
Figures 24, 25:
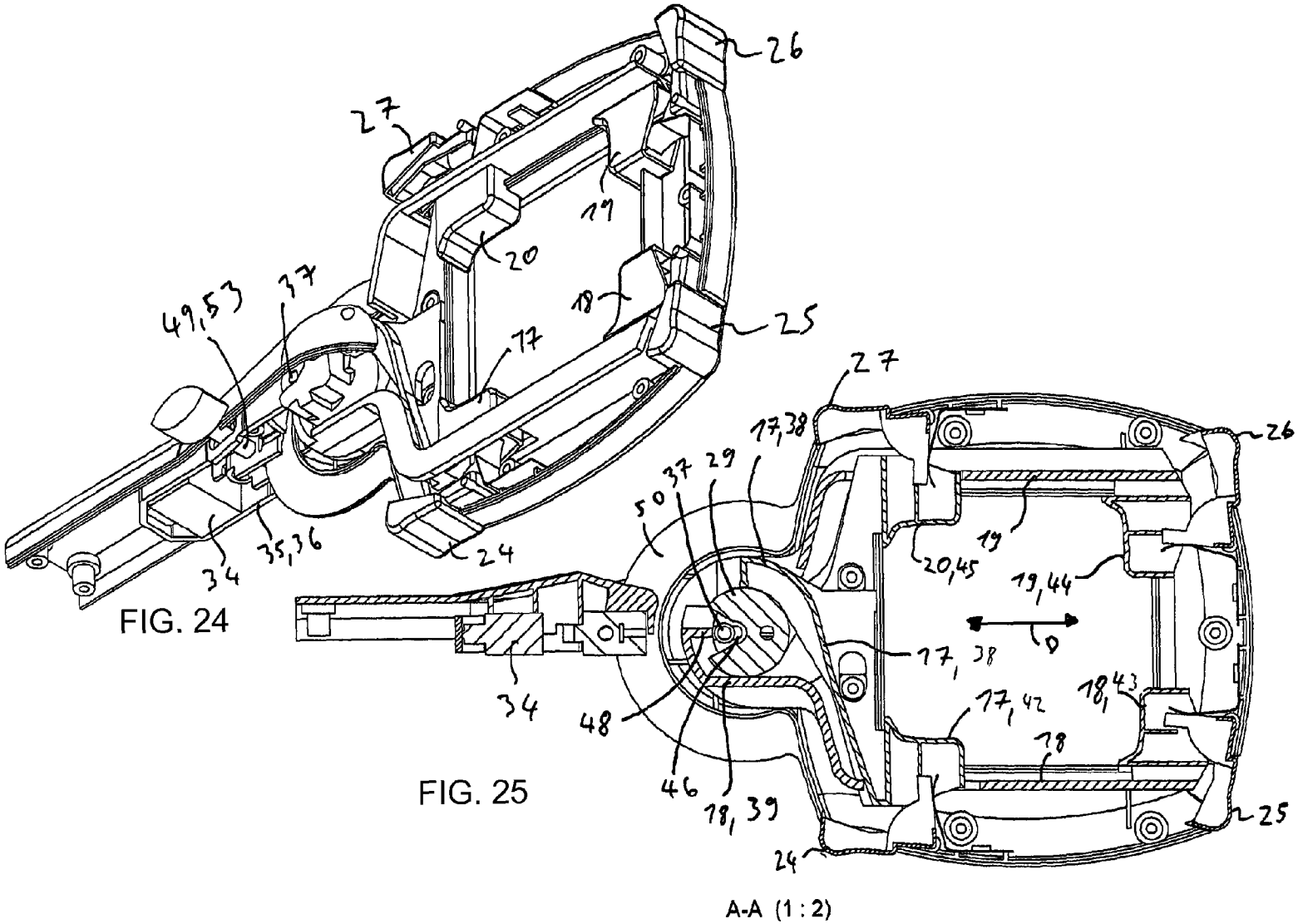

In the centered pivot position (cf. view "from above" in FIGS. 14, 15, 16, and 17, as well as view "from below" in FIGS. 22, 23, 24, and 25), the two activation switches 18 and 19 can be displaced in the direction of the double arrow D. In this connection, the switch hooks 39 (cf. FIG. 23, 25) and 40 (cf. FIGS. 14 and 16) engage on the connection element 37 and thus on the switch bracket 35 for activation of the contact element 34. The handle pivot axle 29 preferably has a recess 46, where the switch bracket 35 engages into the recess 46. Within the recess 46, the corresponding switch hook 39 or 40 engages on the connection element 37. The connection element 37 is displaced by means of displacement of the switch hook 38, 38 in the recess 46. In FIGS. 14 and 23, the connection element 37 is shown in a non-activated position, and in FIGS. 16 and 25, it is shown in an activated position. On the basis of the possibility, which is created in this way, of displacement of the connection element 37 transverse to the handle pivot axle 29, namely preferably within the recess 46, the switch bracket 35 and thus the electrical contact element 34, which is provided outside of the region of the activation handle 16, can be controlled accordingly, preferably turned on, in every pivot position of the activation handle 16, where shut-off is implemented by way of the spring elements within the contact element 34, thereby then moving the connection element back in the reverse direction, as a result of which the activation switch that is interacting with the connection element 37, in each instance, at that particular time, is once again moved back into its starting position.

Here, a section of the recess 46 preferably forms an oblong hole that extends essentially in the radial direction and has open edges. This oblong hole forms a guide for the switch bracket 35, particularly for the connection element 37. The corresponding switch hook 38, 39, 40, 41 engages on the connection element 37 within the recess 46.

As a result, when the switch hook, in each instance, is activated, the triggering element, not indicated here in any detail, of the electrical contact element 34 is pressed into the housing, not indicated here in any detail, of the electrical contact element 34, and the electrical contact is triggered. Another section of the recess 46 in the handle pivot axle 29 is particularly configured essentially in V shape (cf. FIGS. 13, 14, 16, 19, 21, 23, and 25). The corresponding switch hooks 38, 39, 40, and 41 engage into the V-shaped section of the recess 46.

Figure 13:
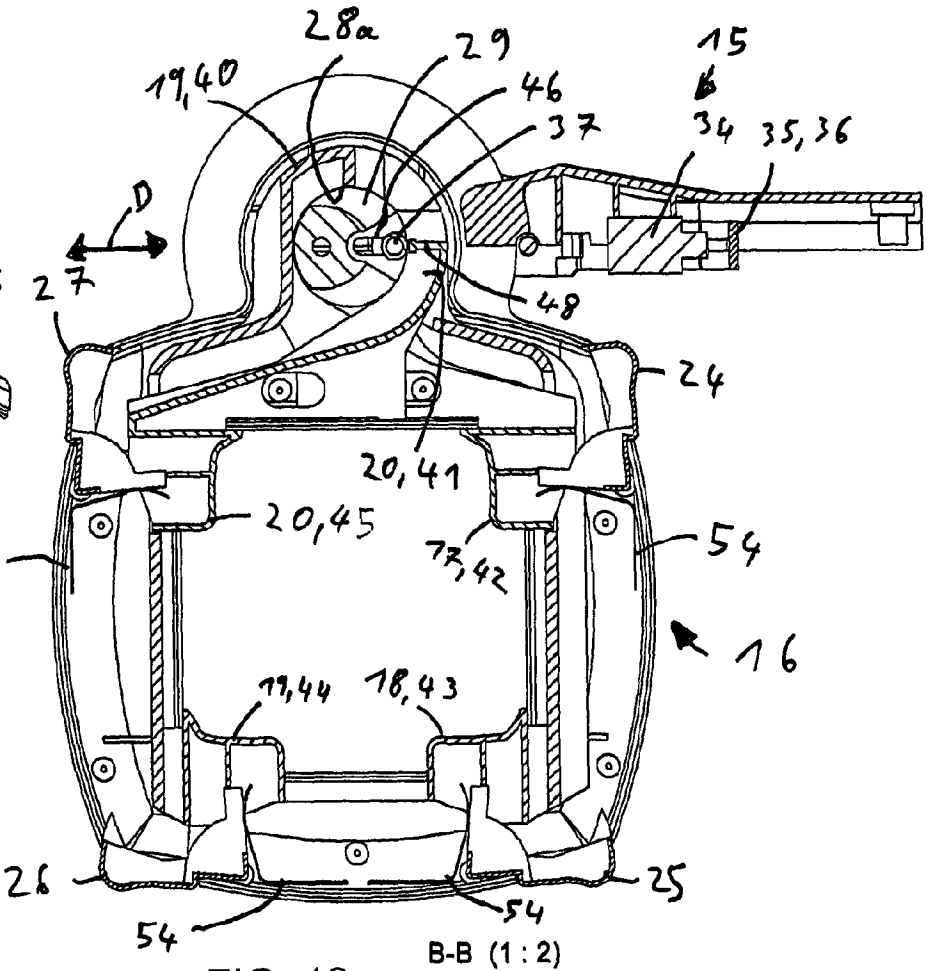

In the left pivot position (cf. view "from below" in FIGS. 10, 11, 12, and 13), only the activation switch 20 can be displaced in the direction of the double arrow D. The switch hook 41 assigned to the activation switch 20 (cf. FIG. 10, 13) engages on the connection element 37 and thus on the switch bracket 35 for activation of the contact element 34, and engages into the V-shaped section of the recess 46. Within the recess 46, the switch hook 41 engages on the connection element 37. The connection element 37 is displaced in the recess 46 by means of displacement of the switch hook 41, i.e. by pressing the activation button 45. In FIGS. 12 and 13, the connection element 37 is shown in a non-activated position, and in FIGS. 10 and 11, it is shown in an activated position.

Figure 19:
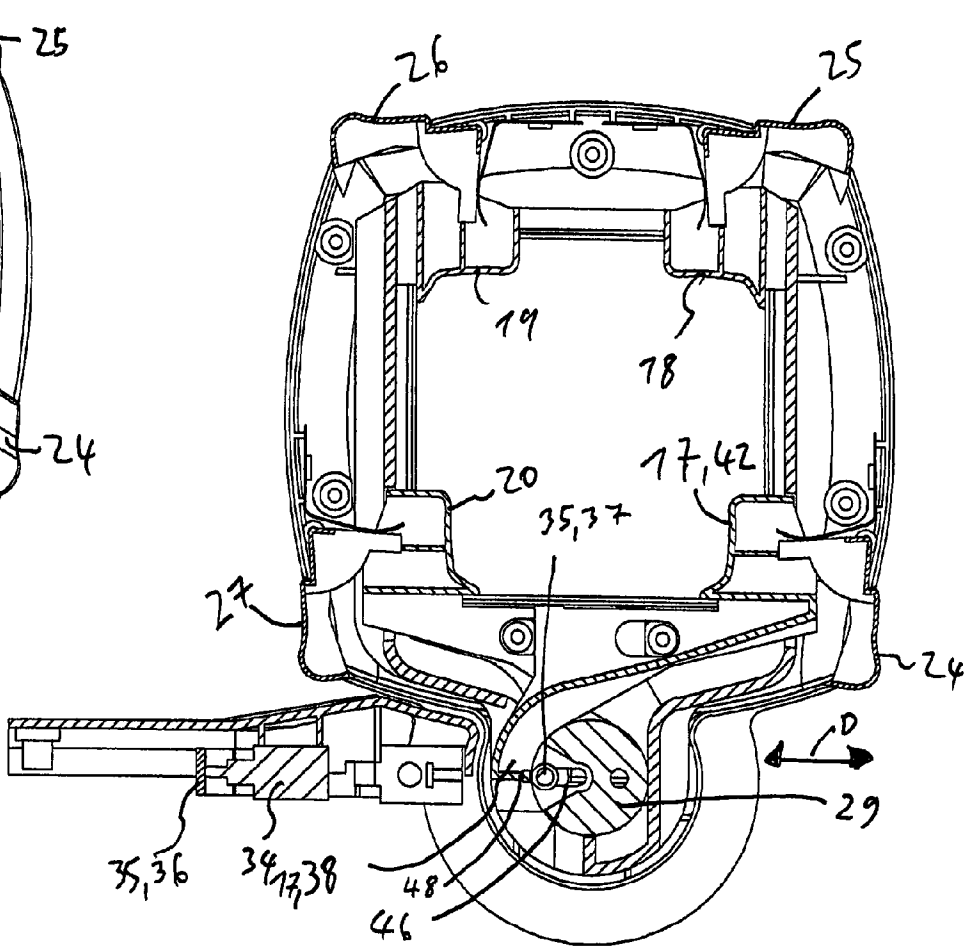
Figure 18:
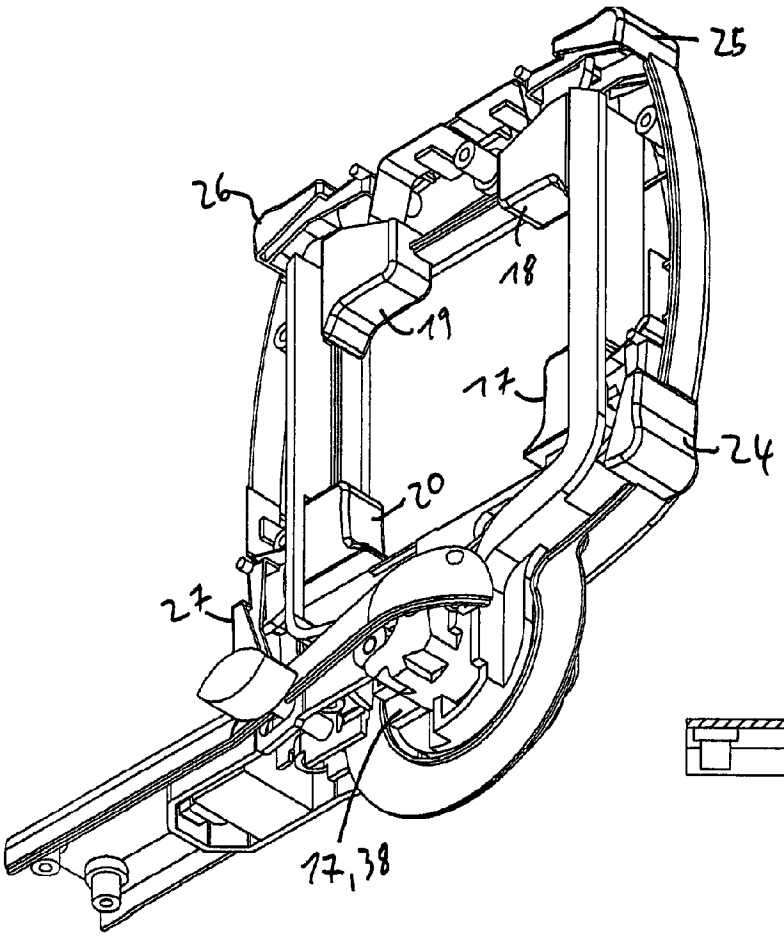
Figure 21:
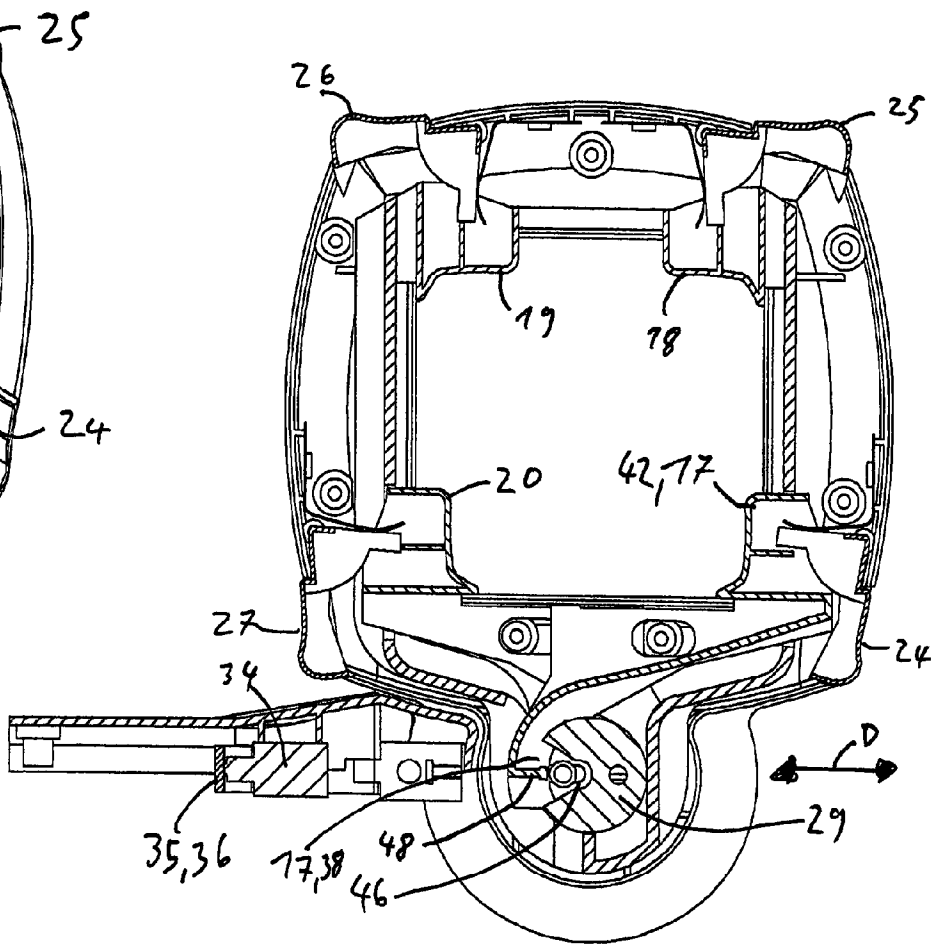
Figure 20:
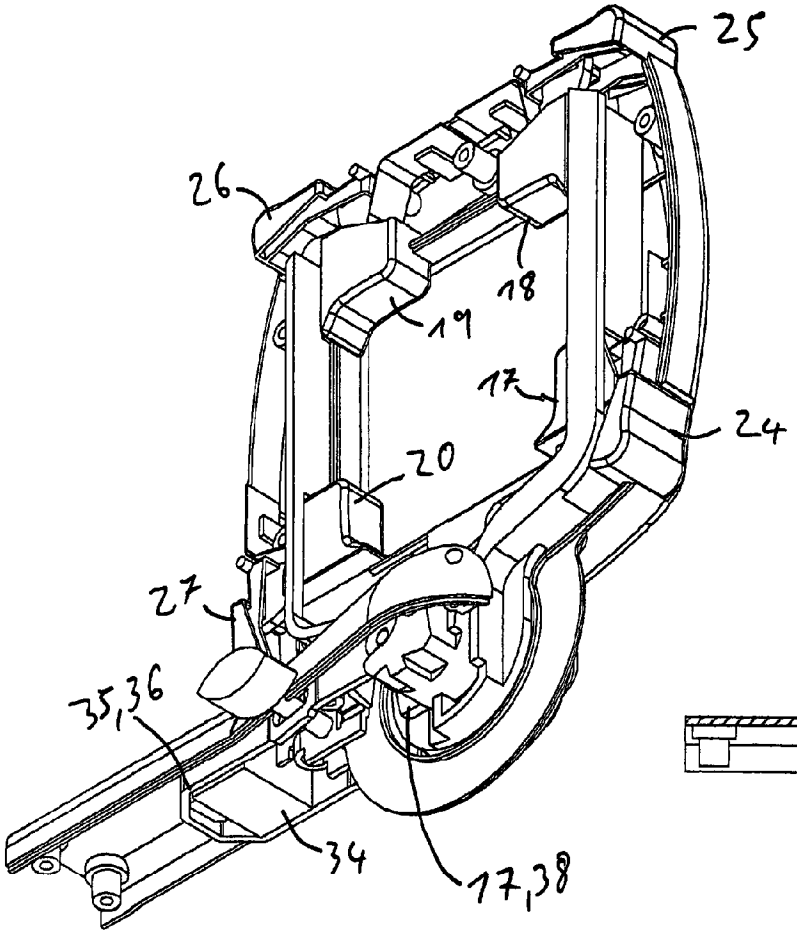

In the right pivot position (cf. view "from above" in FIGS. 18, 19, 20, and 21), only the activation switch 17 can be displaced in the direction of the double arrow D. The switch hook 38 assigned to the activation switch 17 (cf. FIG. 19, 21) engages on the connection element 37 and thus on the switch bracket 35 for activation of the contact element 34, and engages into the V-shaped section of the recess 46. Within the recess 46, the switch hook 38 engages on the connection element 37. The connection element 37 is displaced in the recess 46 by means of displacement of the switch hook 38, i.e. by pressing the activation button 42. In FIGS. 18 and 19, the connection element 37 is shown in a non-activated position, and in FIGS. 20 and 21, it is shown in an activated position.

Activation of the activation buttons 42, 43, 44, 45, in each instance, is now blocked, if the pivot position of the activation handle 16 deviates from the predetermined pivot positions by more than a tolerance angle. In this connection, the tolerance angle is preferably determined by the opening angle of the V-shaped section of the recess 46. If the actual pivot position of the activation handle 16 deviates from the predetermined pivot angle by more than the tolerance angle, the switch hooks 38, 39, 40, 41 bump up against the mantle surface of the handle pivot axle 29. By pivoting the activation handle 16 into one of the predetermined "pivot positions that can be activated," as a result, it becomes possible to activate at least one of the switch hooks 38, 39, 40, 41, and it can therefore interact with the switch element, preferably the switch bracket 35, where the other switch hooks are blocked by the outside circumference surface of the handle pivot axle 29. In each of the first, second, and third pivot positions (activation handle to the left, activation handle to the right, and activation handle centered), at least one switch hook 38, 39, 40, 41 can therefore be activated within a tolerance angle, particularly by way of the corresponding related activation buttons 42, 43, 44, 45, while the other switch hooks and their related activation buttons are specifically blocked—precisely as described above. Preferably, however, as has already been mentioned, two switch hooks can preferably be activated in the centered position of the activation handle 16.

In the following, reference is made, once again, to FIGS. 6, 7*a*, 7*b*, 8, and 9.

Figure 6:
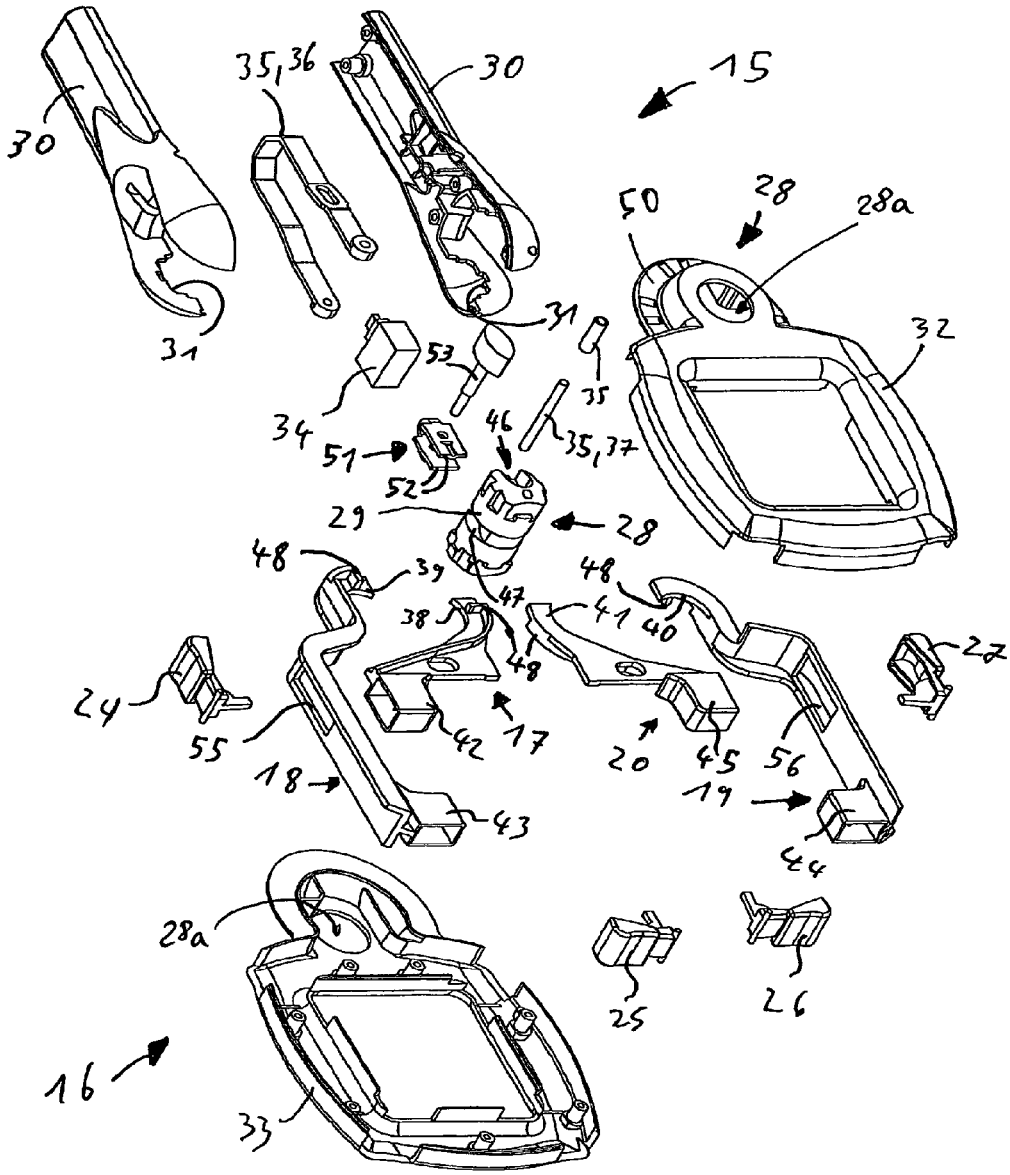

The handle pivot axle 29 has a slit 47 that extends essentially in the circumference direction (cf. FIG. 6). During a switching process, the corresponding switch hook 38, 39, 40, 41 moves at least partly into the slit 47. The switch hooks 38, 39, 40, 41 now have a blocking projection 48, in each instance, that projects preferably upward or downward (cf. also FIG. 6), where the blocking projection 48 can move into the V-shaped section of the recess 46, but not into the slit 47, since otherwise it would hit up against the outer circumference surface of the handle pivot axle 29. In this way, it is ensured that the activation switches 17, 18, 19, 20, in each instance, can be activated accordingly, in each instance, only within a tolerance angle about the related, predetermined, defined pivot position of the activation handle 16, in each instance, particularly only in the predetermined pivot positions to the left, to the right, and centered on the activation handle 16, in each instance.

The connection region 15 furthermore has a holding mechanism 49 (cf. FIGS. 6 and 9), where the holding mechanism 49 can releasably fix the pivot position of the activation handle 16 in place. The activation handle 16 has a ring segment structure 50, which preferably also radially encloses the bearing eye 28*a*, at least in part. The ring segment structure 50 interacts with the holding mechanism 49. The holding mechanism 50 can be releasably fixed in place on the ring segment structure 50, to fix the pivot position of the activation handle 16 in place. The holding mechanism 49 can be connected with the ring segment structure 50 in clamping manner. The holding mechanism 49 has a preferably U-shaped clamping piece 51. In this connection, the clamping piece 51 can have two clamping shanks 52, where the holding mechanism 49 furthermore has a clamping screw 53 that connects the two clamping shanks 52. Here, the ring segment structure 50 is disposed between the clamping shanks 52, at least in part. The ring segment structure 50 can be clamped between the two clamping shanks 52 by turning the clamping screw 53.

Figures 7A, 7B:
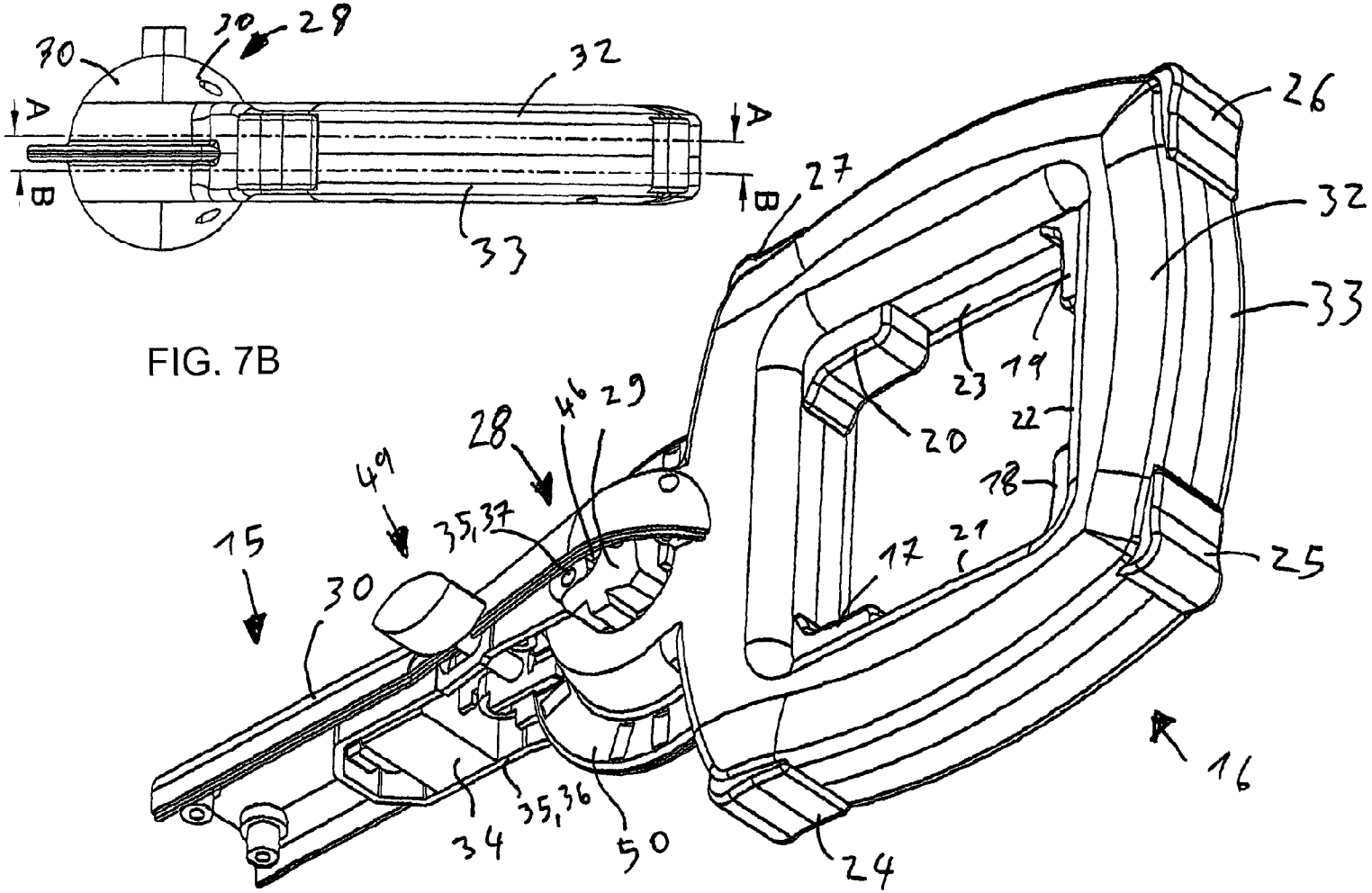
Figure 9:
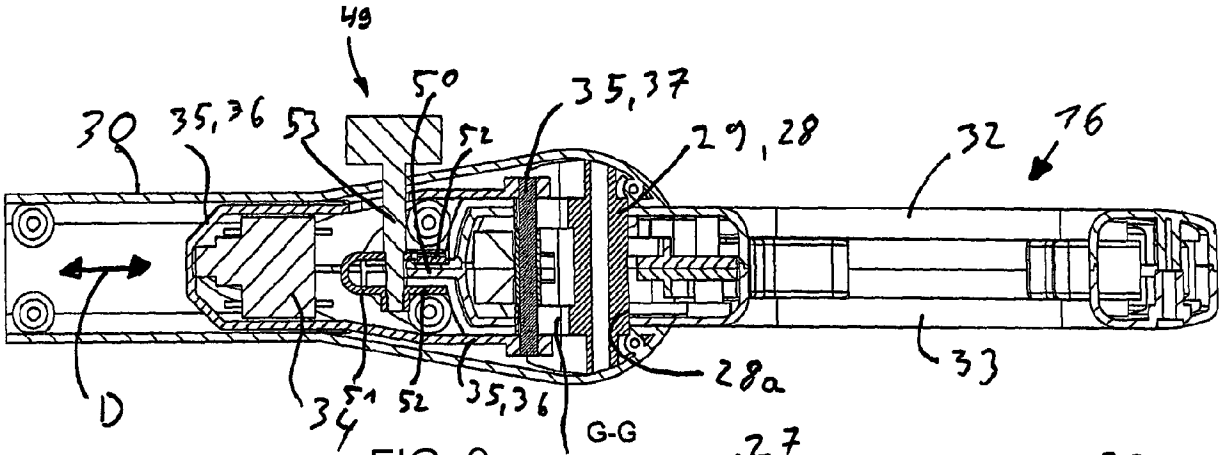
Figure 8:
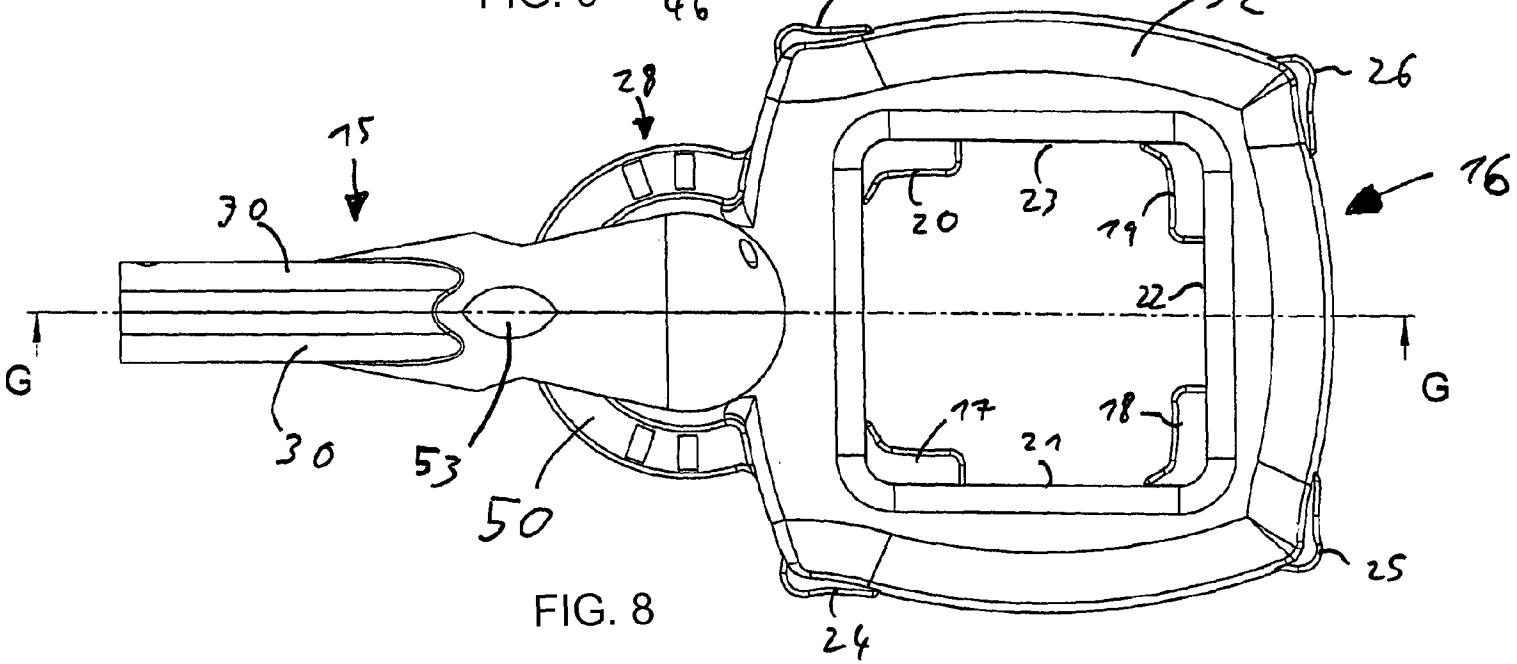

Multiple depressions on the ring segment structure 50, which are not indicated in any greater detail here, are shown in FIG. 7*a* and FIG. 6. In this connection, one of the clamping shanks 52 engages into the ring segment structure when this catch position is reached, so that the user receives feedback about the fact that he/she has reached a predetermined pivot position of the activation handle 16. Depressions in the ring segment structure 50 disposed next to them indicate the tolerance angle or opening angle of the V-shaped section of the recess 46, within which the active activation switches 17, 18, 19, 20, in each instance, can be activated.

Figure 10:
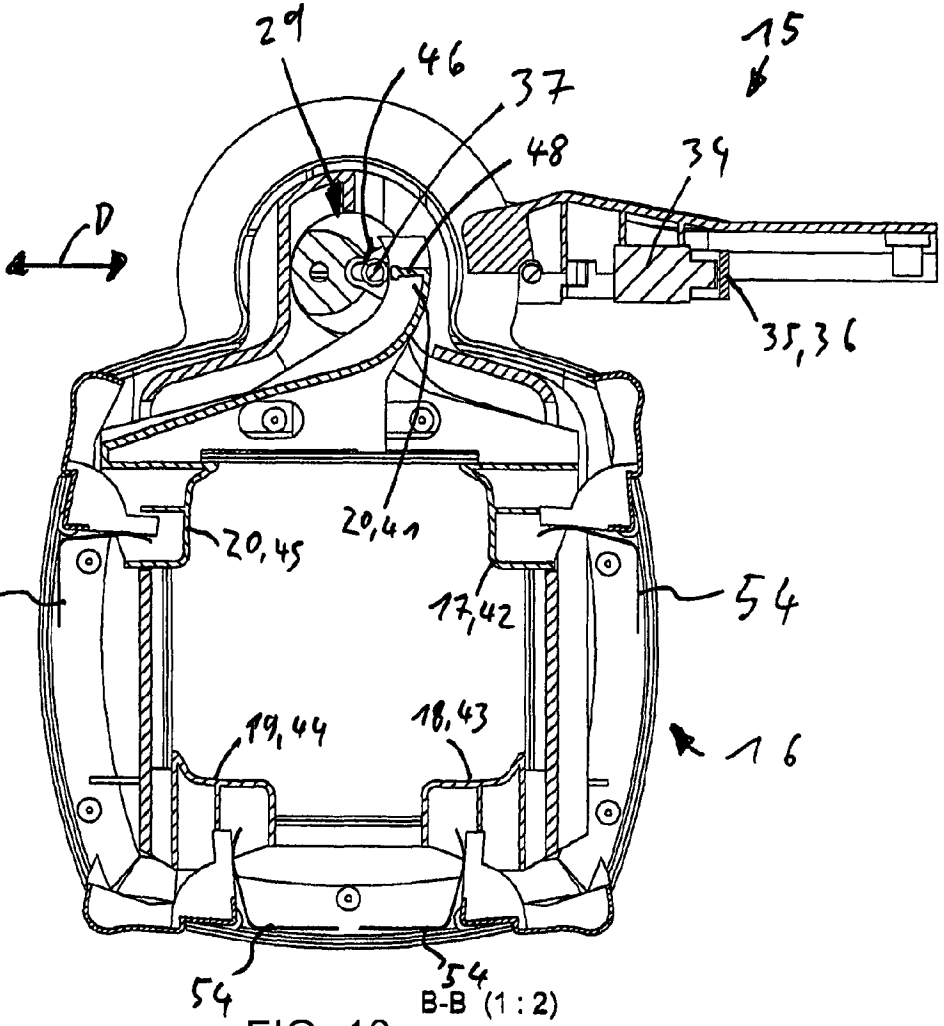
Figure 11:
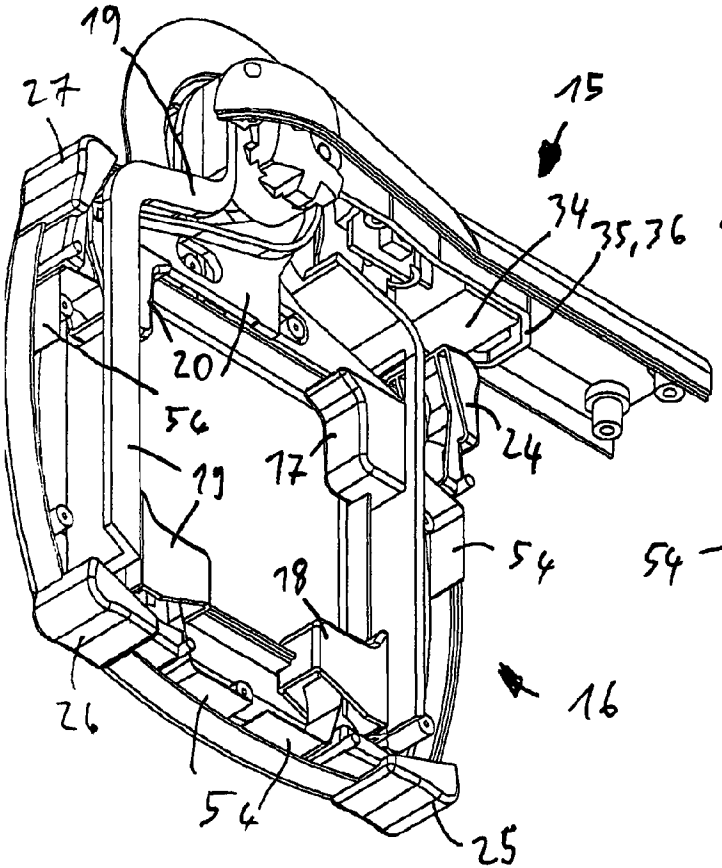
Figure 12:
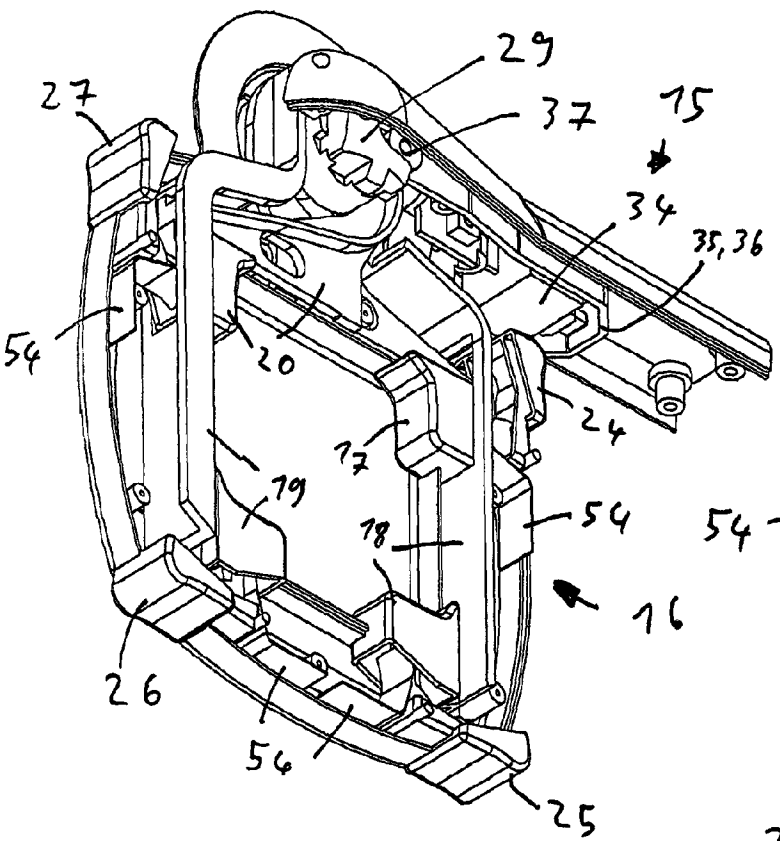
Figure 15:
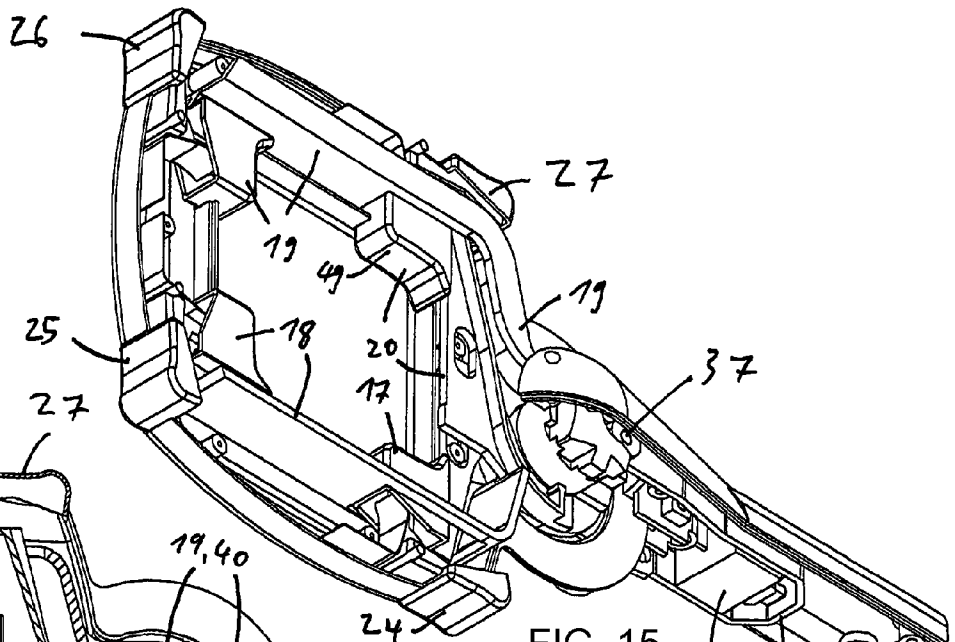

The securing buttons 24, 25, 26, 27 are biased by means of spring clips 54, in each instance (cf. FIGS. 10 and 11). By means of the spring clips 54, the securing buttons 24, 25, 26, 27 are biased against the corresponding activation switches 17, 18, 19, 20, so that the activation switches 17, 18, 19, 20 are forced into the "non-activated" position (cf. FIG. 10) or are "blocked" in this position until this position is released by means of activation of the securing button, in each instance.

The method of operation of the activation handle 16 can be summarized as follows—for example for the "right" pivot position:

In the "right" pivot position shown in FIG. 2—or 90° to the right relative to the circular saw blade—the securing button 24 is activated with the thumb, thereby releasing the activation switch 17. As the next thing, the activation button 42 assigned to the activation switch 17 can be pressed. The switch hook 38 assigned to the activation switch 17 (cf. FIG. 19) then presses on the switch bracket 35, particularly on the connection element 37, which is guided in the recess 46, particularly the oblong-hole-shaped section of the recess 46. As a result, the bracket 36 is pressed against the electrical contact element 34 and counter to a spring force that is applied here, and this triggers the electrical switching process. The movement sequence is reversed, by way of the spring force applied in the contact element 34, when the activation button 42 is released. The remaining activation buttons 43, 44, 45 cannot be activated here in this "right" pivot position, even if the securing buttons 25, 26, 27 are pressed.

Here, the predetermined "left, right, centered" pivot positions preferably correspond to the pivot angles −90°, +90°, and 0° relative to the plane of the circular saw blade. The tolerance angle preferably amounts to essentially 20°. In other words, the activation handle 16 can be activated within pivot angles +90° to +70°, +20° to −20°, −70° to −90°. The function is queried by the blocking projection 48, which here is configured as a crosspiece on the switch hook 38, 39, 40, 41, in each instance (cf. FIG. 9). If the angle deviation is greater than the tolerance angle, the blocking projections 48 do not release the switching process, in each instance. In the pivot position shown in FIG. 19, only the activation switch 17 can be activated. In the pivot position shown in FIG. 3, both activation switches 18 and 19 can be activated, and in the pivot position shown in FIG. 1, only the activation switch 20 can be activated.

The above explanations show that the activation handle 16 is therefore suitable for many types of electric tools 1 and can particularly be disposed and used on a corresponding electric tool 1, where this is practical.

REFERENCE SYMBOL LIST

1 electric tool
2 saw
3 compound miter saw and miter saw
4 work piece support table
5 arm
6 sawing apparatus
7 turntable
8 cantilever
9 saw slit
10 saw blade cover
11 slide guide device
12 pivot articulation connection
13 guide rod
14 pivot axle
15 connection region
15*a* cantilever
16 activation handle
17 activation switch
18 activation switch
19 activation switch
20 activation switch
21 inner side
22 inner side
23 inner side
24 safety button
25 safety button
26 safety button
27 safety button
28 articulated connection
28*a* bearing eye
29 handle pivot axle
30 shell part
31 accommodation
32 handle shell part
33 handle shell part
34 contact element

35 switch bracket
36 bracket
37 connection element
38 switch hook
39 switch hook
40 switch hook
41 switch hook
42 activation button
43 activation button
44 activation button
45 activation button
46 recess
47 slit
48 blocking projection
49 holding mechanism
50 ring segment structure
51 clamping piece
52 clamping shank
53 clamping screw
54 spring clip
55 window
56 window
D double arrow

The invention claimed is:

1. An electric tool, comprising:

a connection region and an activation handle pivotally disposed on said connection region;

wherein said activation handle is mounted for pivoting into multiple pivot positions, and said activation handle has at least one activation switch for electrically activating the electric tool;

an articulated connection connecting said activation handle and said connection region to one another, said articulated connection having a bearing eye and a handle pivot axle in engagement with said bearing eye, said connection region including an electrical contact element and said electrical contact element being mechanically activatable, with functional effect, by way of at least one activation switch, said connection region including a switch element mounted for displacement by said activation switch, and said contact element being mounted for activation by way of a displacement of said switch element, said at least one activation switch being one of a plurality of activation switches each having an activation button connected with a respective switch hook, and/or having a respective switch hook, and wherein said switch hooks are displaceably or movably mounted in said activation handle, such that when said activation buttons are activated, said switch hooks interact with said switch element.

2. The electric tool according to claim 1, wherein said activation handle is pivotally mounted on said handle pivot axle.

3. The electric tool according to claim 1, wherein said handle pivot axle extends transversely to said activation handle.

4. The electric tool according to claim 3, wherein said handle pivot axle extends perpendicularly to said activation handle.

5. The electric tool according to claim 1, wherein said activation handle pivotally mounted into at least three pivot positions and one separate activation switch is provided for each of said at least three pivot positions.

6. The electric tool according to claim 1, wherein said at least three pivot positions include:

a first pivot position, in which said activation handle is directed to the right relative to said connection region;

a second pivot position, in which said activation handle is oriented centered relative to said connection region; and a third pivot position, in which said activation handle is directed to the left relative to said connection region.

7. The electric tool according to claim 1, wherein said switch element is a switch bracket.

8. The electric tool according to claim 1, wherein said pivot handle axle is formed with a recess and wherein at least a part of said switch element engages into said recess.

9. The electric tool according to claim 8, wherein said switch element is a switch bracket with a connection element engaging in said recess.

10. The electric tool according to claim 9, wherein said switch bracket has a bracket with two shanks and a connection element, said connection element connecting said shanks with one another and said connection element engaging into said recess of said handle pivot axle.

11. The electric tool according to claim 10, wherein said connection element is a pin-shaped connection element.

12. The electric tool according to claim 10, wherein said switch hooks interact with said connection element.

13. The electric tool according to claim 8, wherein an activation of a respective said activation button is blocked if a current pivot position of said activation handle deviates from a predetermined pivot position by more than a specific tolerance angle.

14. The electric tool according to claim 13, wherein said tolerance angle is determined by an opening angle of at least one section of said recess, and wherein said switch bracket can only be activated when said switch hook or hooks can also be moved into the section of said recess.

15. The electric tool according to claim 1, wherein said activation handle has a substantially rectangular frame shape, said activation buttons are disposed on three inner sides of said frame shape and safety switches are disposed on corresponding outer sides of said frame shape.

16. The electric tool according to claim 1, wherein said connection region includes a holding mechanism configured to releasably fix the pivot position of said activation handle in place.

17. The electric tool according to claim 16, wherein said activation handle has a ring segment structure, said holding mechanism has a U-shaped clamping piece, and said holding mechanism is configured to be connected with said ring segment structure in clamping manner.

18. The electric tool according to claim 17, wherein said clamping piece has two clamping shanks and a clamping screw connecting said clamping shanks, and wherein said ring segment structure extends, at least in part, between said clamping shanks.

19. An electric tool, comprising:

a connection region and an activation handle pivotally disposed on said connection region, said connection region having a switch element;

wherein said activation handle is mounted for pivoting into multiple pivot positions, and said activation handle has at least one activation switch for electrically activating the electric tool;

an articulated connection connecting said activation handle and said connection region to one another, said articulated connection having a bearing eye and a handle pivot axle in engagement with said bearing eye, said handle pivot axle being formed with a recess and at least a part of said switch element engages into said recess;

said activation switch being formed with a blocking projection, said blocking projection being movable into said recess, when the activation handle is disposed in a pivot position of the activation handle that can be activated, and said blocking projection not being movable into said recess, due to hitting up against an outer circumference surface of said handle pivot axle when said activation handle is disposed in a pivot position that deviates more than a predetermined tolerance angle from the pivot position that can be activated.

* * * * *